US009540812B2

(12) United States Patent
Tsai

(10) Patent No.: US 9,540,812 B2
(45) Date of Patent: Jan. 10, 2017

(54) BRACING DEVICE

(71) Applicant: Chong-Shien Tsai, Taichung (TW)

(72) Inventor: Chong-Shien Tsai, Taichung (TW)

( * ) Notice: Subject to any disclaimer, the term of this patent is extended or adjusted under 35 U.S.C. 154(b) by 0 days.

(21) Appl. No.: 14/611,476

(22) Filed: Feb. 2, 2015

(65) Prior Publication Data

US 2015/0259899 A1 Sep. 17, 2015

(30) Foreign Application Priority Data

Mar. 17, 2014 (TW) ..... 103109851 A

(51) Int. Cl.

| | |
|---|---|
| ***E04C 3/02*** | (2006.01) |
| ***E04B 1/98*** | (2006.01) |
| ***E04B 1/18*** | (2006.01) |
| ***E04H 9/02*** | (2006.01) |
| *E04B 1/24* | (2006.01) |

(52) U.S. Cl.

CPC . *E04C 3/02* (2013.01); *E04B 1/18* (2013.01); *E04B 1/98* (2013.01); *E04H 9/02* (2013.01); *E04H 9/021* (2013.01); *E04H 9/027* (2013.01); *E04H 9/028* (2013.01); *E04B 2001/2442* (2013.01); *E04B 2001/2496* (2013.01); *E04H 9/024* (2013.01)

(58) Field of Classification Search

CPC ..... E04B 1/18; E04B 1/98; E04B 9/02; E04B 9/028; E04C 3/02; E04H 9/02; E04H 9/028

See application file for complete search history.

(56) References Cited

U.S. PATENT DOCUMENTS

| | | | | |
|---|---|---|---|---|
| 5,471,810 | A * | 12/1995 | Sugisawa | E04C 3/04 52/167.3 |
| 6,295,770 | B1 * | 10/2001 | Sheu | E04B 1/161 52/167.1 |
| 6,826,874 | B2 * | 12/2004 | Takeuchi | E04H 9/02 52/167.1 |
| 6,837,010 | B2 * | 1/2005 | Powell | E04H 9/02 403/174 |
| 7,174,680 | B2 * | 2/2007 | Smelser | E04C 3/02 52/167.1 |
| 7,185,462 | B1 * | 3/2007 | Smelser | E04H 9/02 52/167.1 |

(Continued)

FOREIGN PATENT DOCUMENTS

| | | |
|---|---|---|
| TW | I245828 | 8/2005 |
| TW | I262229 | 8/2005 |
| TW | I328633 | 10/2008 |

*Primary Examiner* — Eret McNichols

(74) *Attorney, Agent, or Firm* — patenttm.us

(57) ABSTRACT

A bracing device has a supporting module and a restraining module mounted around the supporting module to provide a restraining-supporting effect to the supporting module. The supporting module has at least one supporting element. The at least one supporting element is elongated and has an axial segment and two connecting heads. The connecting heads are respectively formed on two connecting ends of the axial segment. The restraining module has at least one restraining board and at least one viewing hole. The at least one restraining board has a restraining frame and a filling member mounted in the restraining frame. The at least one viewing hole is formed through the restraining module and aligns with the axial segment of the at least one supporting element.

15 Claims, 54 Drawing Sheets

(56) References Cited

U.S. PATENT DOCUMENTS 7,225,588 B2 * 6/2007 Nakamura ..... F16F 7/00 52/167.1
7,284,358 B2 * 10/2007 Smelser ..... E04C 3/02 264/221
7,305,799 B2 * 12/2007 Smelser ..... E04C 3/02 52/167.1
7,461,481 B2 * 12/2008 Tsai ..... E04B 1/2403 52/167.3
8,028,494 B2 * 10/2011 Denn ..... E04B 1/18 52/289
8,250,818 B2 * 8/2012 Tremblay ..... E04H 9/02 52/1
8,789,319 B2 * 7/2014 Li ..... E04B 1/98 188/378
8,973,312 B2 * 3/2015 Tsai ..... E04B 1/98 248/636
9,016,007 B2 * 4/2015 Marinovic ..... E04H 9/024 52/167.1
9,140,006 B2 * 9/2015 Tsai ..... E04B 1/98
2004/0074161 A1 * 4/2004 Kasai ..... E04H 9/02 52/167.1
2004/0074723 A1 * 4/2004 Tsai ..... E04H 9/02 188/371
2005/0166487 A1 * 8/2005 Tsai ..... E04H 9/02 52/167.3
2005/0257490 A1 * 11/2005 Pryor ..... E04H 9/14 52/834
2008/0250732 A1 * 10/2008 Tsai ..... E04H 9/02 52/167.3
2010/0018134 A1 * 1/2010 Tsai ..... E04H 9/02 52/167.3
2010/0319274 A1 * 12/2010 Tsai ..... E04H 9/02 52/167.3
2012/0233955 A1 * 9/2012 Tsai ..... E04H 9/02 52/653.1
2012/0266548 A1 * 10/2012 Tremblay ..... E04H 9/02 52/167.3
2013/0139452 A1 * 6/2013 Tsai ..... E04B 1/98 52/167.3
2015/0225951 A1 * 8/2015 Tsai ..... E04C 3/04 52/836
2015/0225952 A1 * 8/2015 Tsai ..... E04C 3/04 52/836
2015/0225954 A1 * 8/2015 Tsai ..... E04C 3/06 52/836
2015/0225972 A1 * 8/2015 Tsai ..... E04C 3/00 52/848

* cited by examiner

BRACING DEVICE

BACKGROUND OF THE INVENTION

1. Field of the Invention

The present invention relates to a strengthening support device for buildings and civil engineering structures, and more particularly to a bracing device that has at least one viewing hole to enable an inspector to see an interior structure of the bracing device conveniently to ensure the structural safety of a building or a civil engineering structure.

2. Description of Related Art

To strengthen the structural toughness and the supporting strength of a large building and civil engineering structures, conventional bracing devices are used between the beams and the pillars of the building to provide a proper axial resilience, to strengthen the structure and to eliminate the vibration energy and other performance. The applicant had previously proposed a bracing device for a structure such as the Taiwan Patent Numbers: I328633, I262229 and I245828. In the above-mentioned patents, the bracing device has a supporting element and a restraining module. The restraining module is mounted around the supporting element to provide a supporting and restraining effect to the supporting element, and this can prevent the supporting element from buckling under pressure.

The applicant has previously proposed various types of bracing device that can meet the different supporting needs of buildings. When the buildings are deformed by an earthquake or a strong wind, the conventional bracing devices can be used to against the lateral forces that are produced by the earthquake or the strong wind to reduce the shaking conditions of buildings. However, after the earthquake or the strong wind, an inspector cannot inspect the damage of the supporting element due to the restraining module is fully mounted around the supporting element. Then, the inspector needs to dismantle the restraining module from the supporting element during an inspecting process of the structural safety of the building. Particularly, the cost of re-constructing the restraining module is high, the re-construction of the restraining module is difficult and this will become a major limit when inspecting the structural safety of the building. Consequently, the inspector only can skip the inspection of the supporting element of the conventional bracing device and this will generate hidden worries of the structural safety of the building.

To overcome the shortcomings, the present invention tends to provide a bracing device to mitigate or obviate the aforementioned problems.

SUMMARY OF THE INVENTION

The main objective of the invention is to provide a bracing device that has at least one viewing hole to enable an inspector to see an interior structure of the bracing device conveniently to ensure the structural safety of a building or a civil engineering structure.

The bracing device in accordance with the present invention has a supporting module and a restraining module mounted around the supporting module to provide a restraining-supporting effect to the supporting module. The supporting module has at least one supporting element. The at least one supporting element is elongated and has an axial segment and two connecting heads. The connecting heads are respectively formed on two connecting ends of the axial segment. The restraining module has at least one restraining board and at least one viewing hole. The at least one restraining board has a restraining frame and a filling member mounted in the restraining frame. The at least one viewing hole is formed through the restraining module and aligns with the axial segment of the at least one supporting element.

Other objects, advantages and novel features of the invention will become more apparent from the following detailed description when taken in conjunction with the accompanying drawings.

DETAILED DESCRIPTION OF PREFERRED EMBODIMENT

Figure 1:
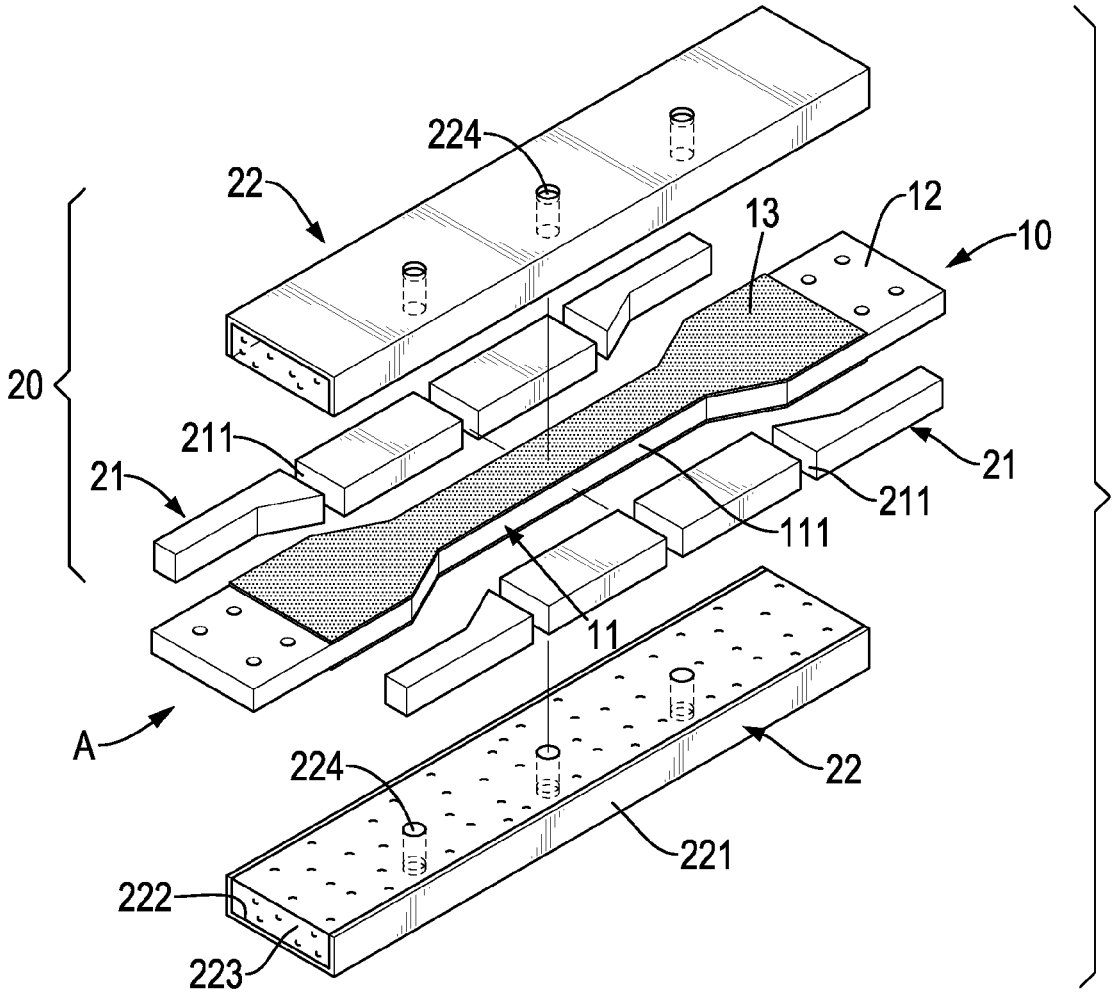
FIG. 1 is an exploded perspective view of a first embodiment of a bracing device in accordance with the present invention.

A bracing device in accordance with the present invention can be applied to a building, a bridge or an instrument between pillars and beams of such structures, and comprises a supporting module A and a restraining module 20 mounted around the supporting module A to provide a restraining-supporting effect to the supporting module A. The supporting module A has at least one supporting element 10. The at least one supporting element 10 is elongated and has an axial segment 11 and two connecting heads 12. The axial segment 11 is elongated and has two connecting ends. The connecting heads 12 are respectively formed on the connecting ends of the axial segment 11. The restraining module 20 has at least one restraining frame 221, a filling member 223, two detaching members 13 and at least one viewing hole 211, 224. The at least one restraining frame 221 is mounted around the axial segment 11 of the at least one supporting element 10. The filling member 223 may be made of concrete or cement mortar and is mounted between the at least one restraining frame 221 and the axial segment 11 of the at least one supporting element 10. The detaching members 13 are mounted on the axial segment 11 adjacent to the filling member 223. The at least one viewing hole 211, 224 is formed through the restraining module 20 to enable a user to see the at least one supporting element 10 without dismantling the restraining module 20.

The bracing device in accordance with the present invention has several embodiments and will be described as follows.

Figure 2:
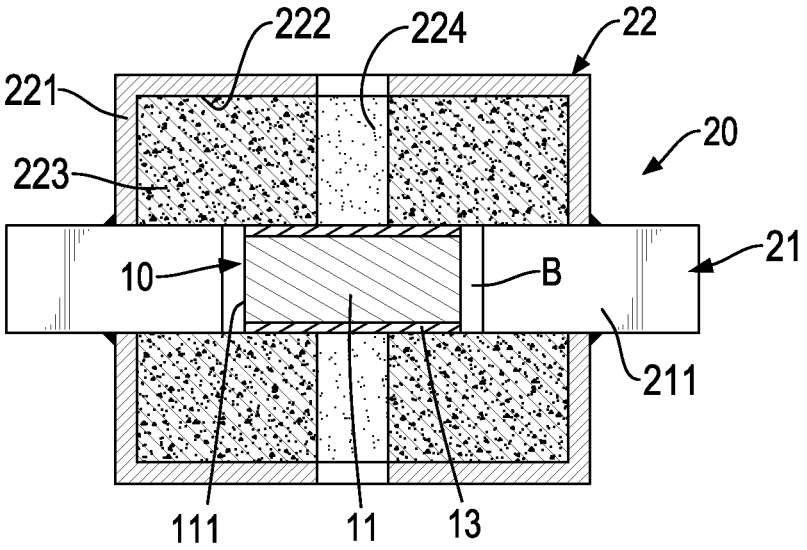
FIG. 2 is an enlarged side view of the bracing device in FIG. 1.

With reference to FIGS. 1 and 2, in a first embodiment of a bracing device in accordance with the present invention, the bracing device has a supporting module A and a restraining module 20 mounted around the supporting module A to provide a restraining-supporting effect to the supporting module A. The supporting module A has an elongated-plate-shaped supporting element 10. The supporting element 10 has an axial segment 11, two connecting heads 12 and two detaching members 13. The axial segment 11 has a first side, a second side, two sidewalls and two connecting ends and two concave edges 111. The concave edges 111 are respectively formed in the sidewalls of the axial segment 11. The connecting heads 12 are respectively formed on the connecting ends of the axial segment 11. Each connecting head 12 may be flat, may be a T shape, a cross shape or flat with a notch, and each connecting head 12 has multiple connecting holes formed through the connecting head 12. Then, the supporting element 10 can be connected to a pillar or a beam of a building by fasteners such as bolts or rivets mounting through the connecting holes of the connecting heads 12 or by welding to connect the supporting element 10 with the pillar or the beam of the building. The detaching members 13 are respectively mounted on the first side and the second side of the axial segment 11, and this can prevent an axial force transferring from the supporting element 10 to the restraining module 20.

The restraining module 20 is mounted around the axial segment 11 of the supporting element 10 and has at least one pair of side boards 21 and two restraining boards 22.

The side boards 21 are respectively mounted in the concave edges 111 of the axial segment 11 at a strong axis direction, and each one of the side boards 21 has an inner side and at least one viewing hole 211. The strong axis direction is a direction which aligns along a direction of the concave edges 111 that are formed in the axial segment 11. The inner sides of the side boards 21 respectively face the concave edges 111 of the axial segment 11 and respectively matched with the concave edges 111 of the axial segment 11 at intervals B as shown in FIG. 2. Preferably, the supporting element 10 and the side boards 21 can be formed by a cutting machine cutting an elongated board to take the maximum advantage of the economic efficiency of the material of the elongated board. In addition, the supporting element 10 has a thickness thinner than the thicknesses of the side boards 21.

The restraining boards 22 are mounted on the supporting element 10 and are securely connected to the side boards 21 by welding, fastening or riveting to enable the restraining module 20 to mount around the supporting element 10. Each one of the restraining boards 22 has a restraining frame 221, a filling member 223 and at least one viewing hole 224. The restraining frame 221 is U-shaped and has an inner side and a filling recess 222 formed in the inner side of the restraining frame 221 to face and mount on the axial segment 11 of the supporting element 10. The filling member 223 may be made of concrete or cement mortar, is mounted in the filling recess 222 of the restraining frame 221 and abuts on the detaching member 13 of the supporting element 10. The at least one viewing hole 224 is formed through the restraining frame 221 and the filling member 223 of the restraining board 22 to enable a user to see the axial segment 11 of the supporting element 10.

Figure 3:
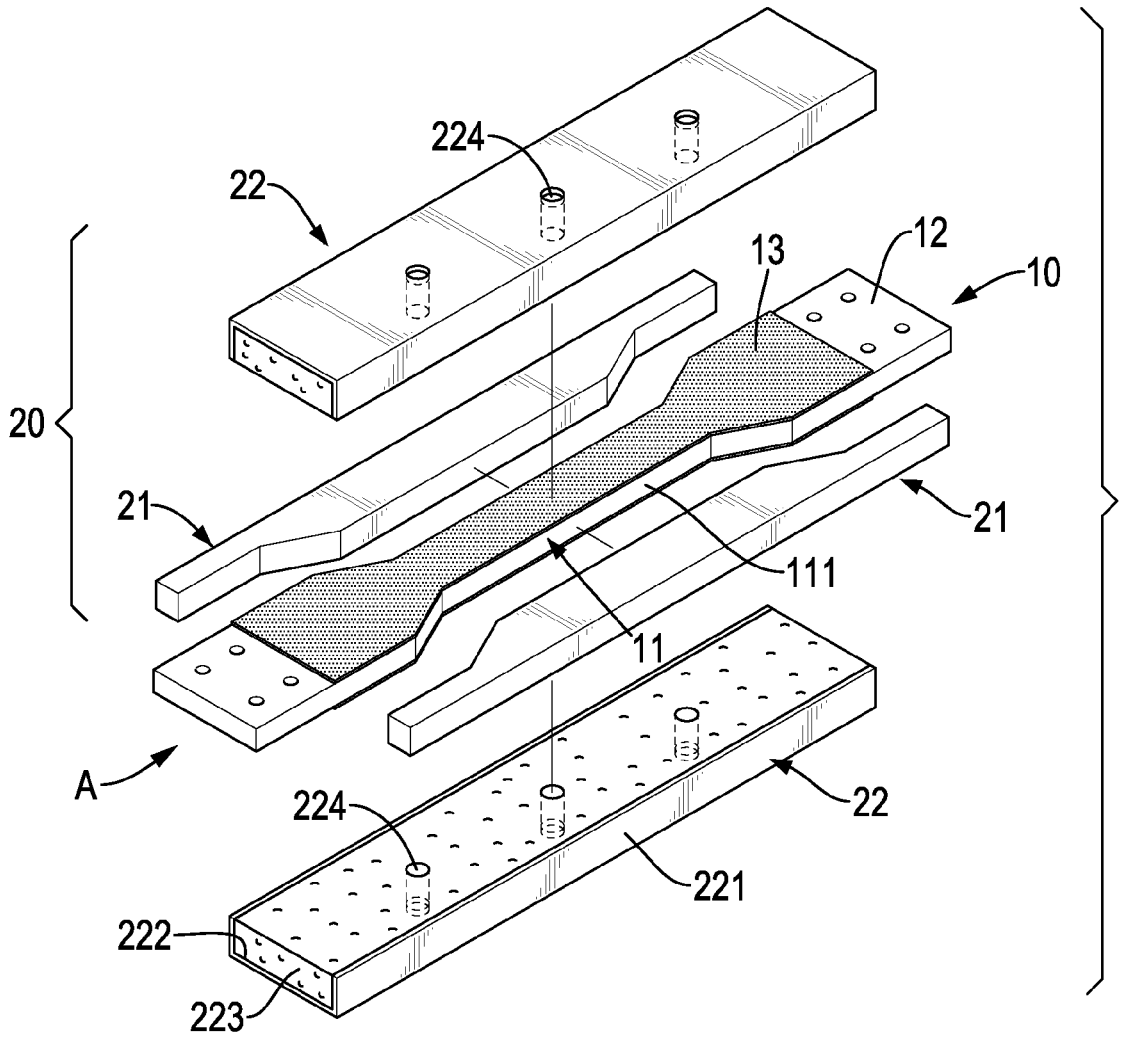
FIG. 3 is an exploded perspective view of a second embodiment of a bracing device in accordance with the present invention.

With reference to FIG. 3, a second embodiment of a bracing device in accordance with the present invention is substantially the same as the first embodiment in FIG. 1 except the following features. Each one of the restraining boards 22 has three viewing holes 224 formed through the restraining board 22 at intervals, and the side boards 21 do not have the viewing holes 211. Then, the user can easily see the axial segment 11 of the supporting element 10 via the viewing holes 224 of the restraining boards 22 of the restraining module 20.

Figure 4:
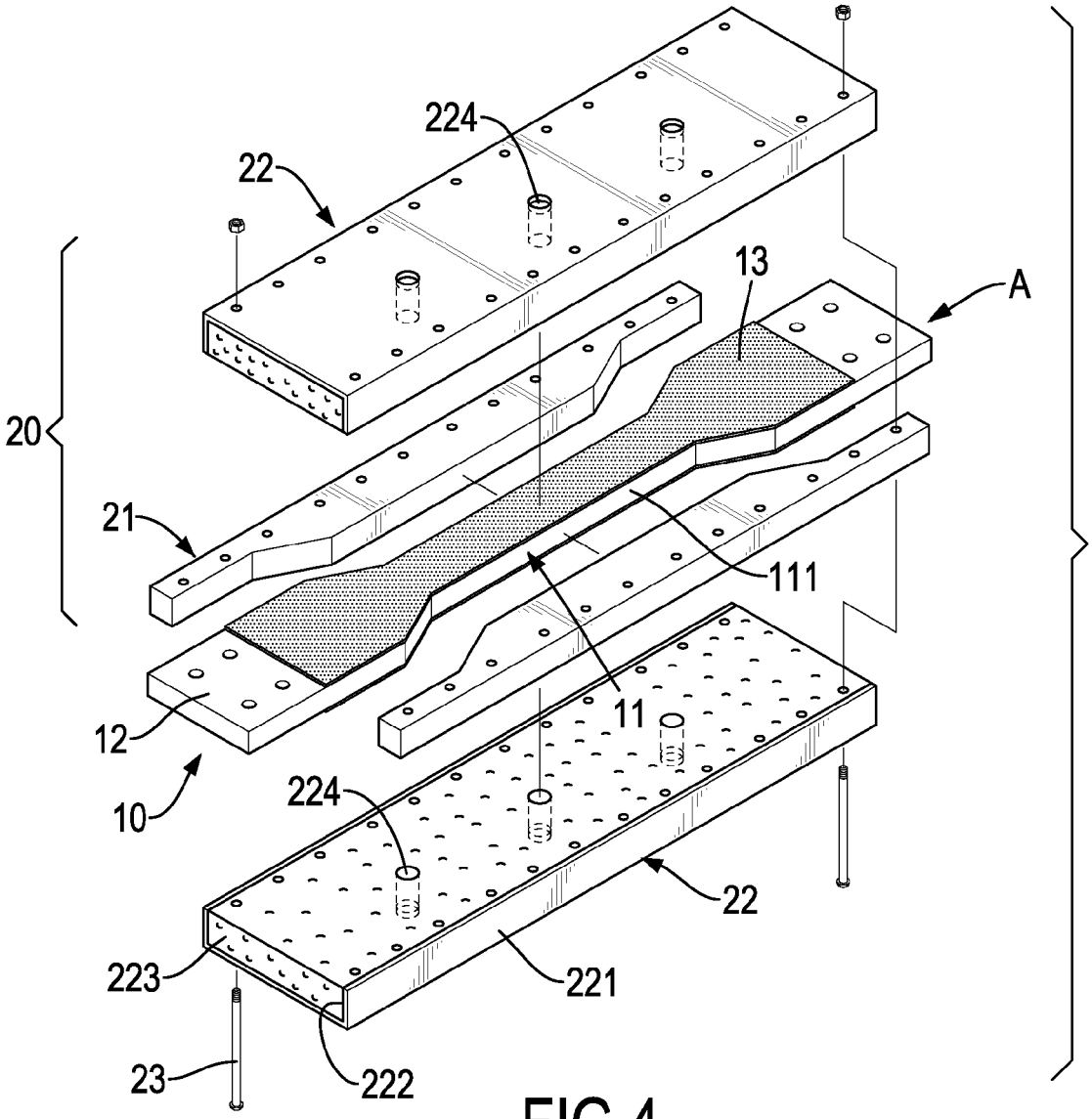
FIG. 4 is an exploded perspective view of a third embodiment of a bracing device in accordance with the present invention.
Figure 5:
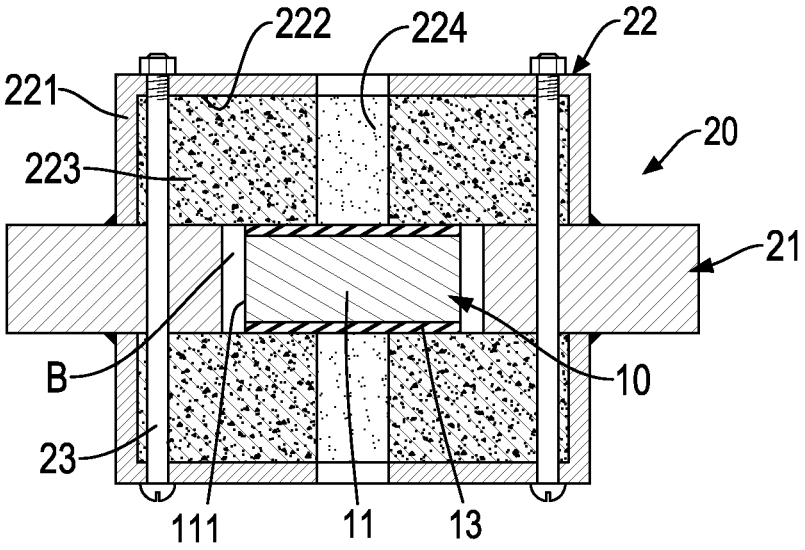
FIG. 5 is an enlarged side view of the bracing device in FIG. 4.

With reference to FIGS. 4 and 5, a third embodiment of a bracing device in accordance with the present invention is substantially the same as the second embodiment in FIG. 3 except the following features. The restraining module 20 has multiple through holes and multiple bolts and nuts 23. The through holes are formed through the side boards 21 and the restraining boards 22 at intervals and align with each other. The bolts and nuts 23 are mounted in the through holes of the side boards 21 and the restraining boards 22 to connect the side boards 21 securely with the restraining boards 22.

Figure 6:
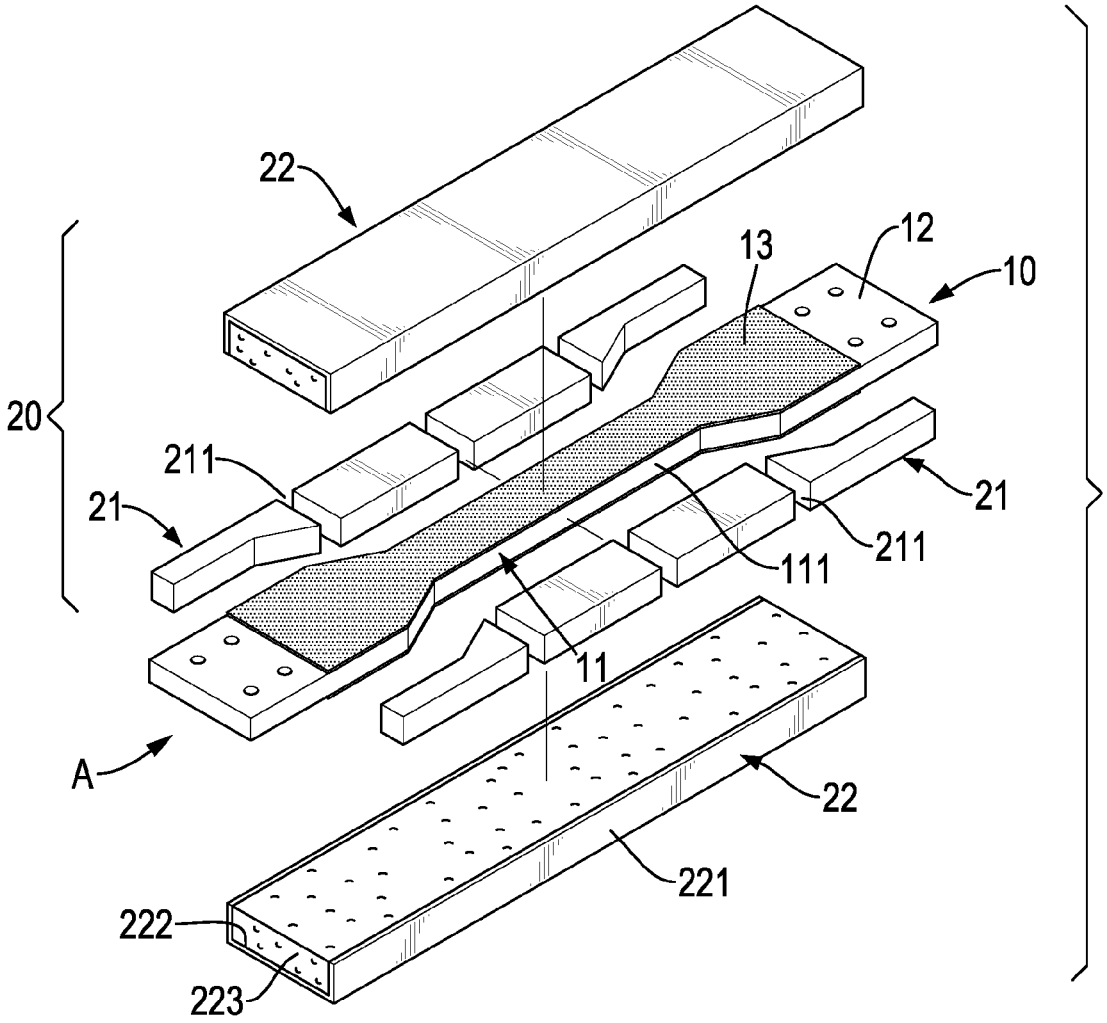
FIG. 6 is an exploded perspective view of a fourth embodiment of a bracing device in accordance with the present invention.

With reference to FIG. 6, a fourth embodiment of a bracing device in accordance with the present invention is substantially the same as the first embodiment in FIG. 1 except the following features. Each one of the side boards 21 has three viewing holes 214 formed through the side board 21 at intervals to align with the axial segment 11 of the supporting element 10, and the restraining boards 22 do not have the viewing holes 224. Then, the user can easily see the axial segment 11 of the supporting element 10 via the viewing holes 211 of the side boards 21 of the restraining module 20.

Figure 7:
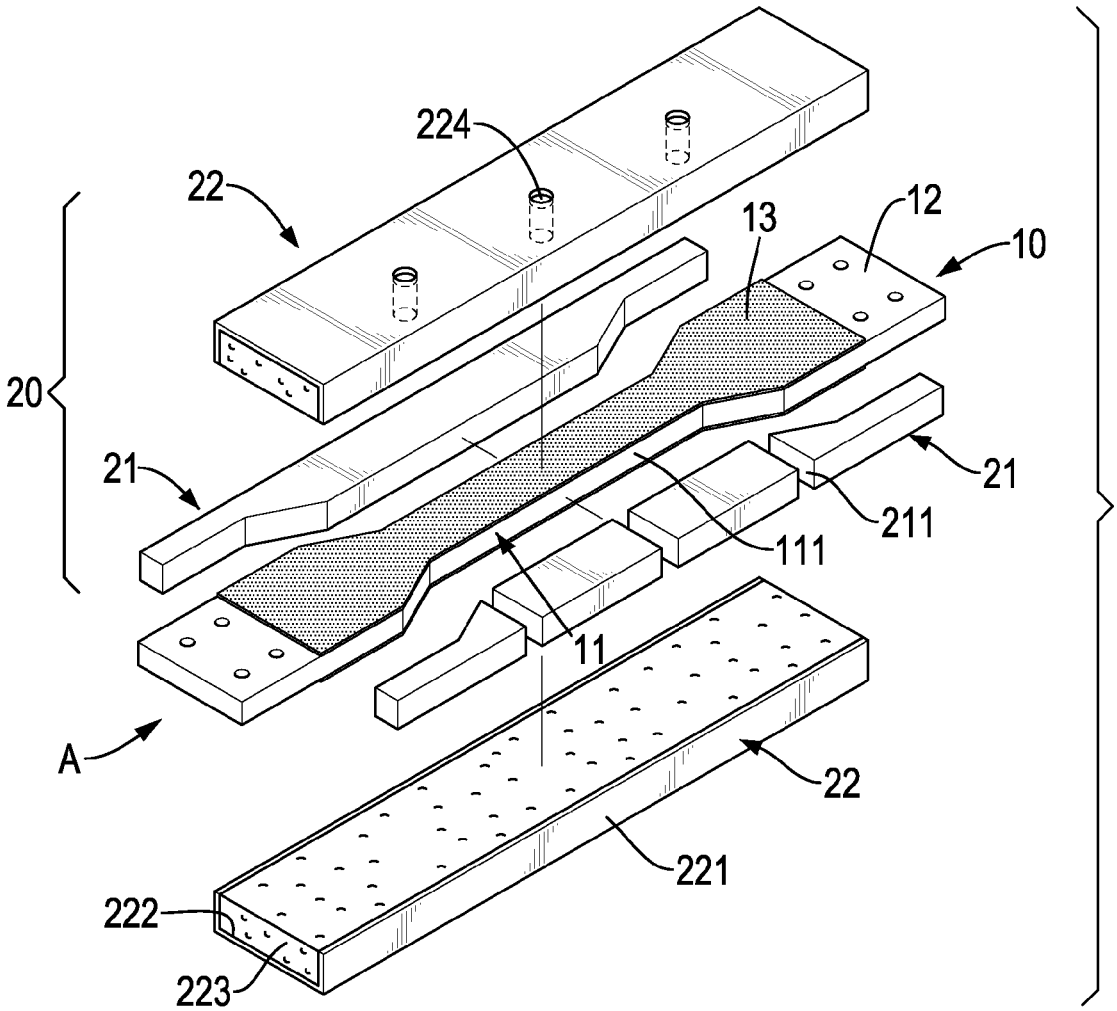
FIG. 7 is an exploded perspective view of a fifth embodiment of a bracing device in accordance with the present invention.

With reference to FIG. 7, a fifth embodiment of a bracing device in accordance with the present invention is substantially the same as the first embodiment FIG. 1 except the following features. One of the side boards 21 has three viewing holes 211 formed through the side board 21 at intervals to align with the axial segment 11 of the supporting element 10, and one of the restraining boards 22 has three viewing holes 224 formed through the restraining board 22 at intervals to align with the axial segment 11 of the supporting element 10. Then, the user can easily see the axial segment 11 of the supporting element 10 via the viewing holes 211 of the corresponding side board 21 or the viewing holes 224 of the corresponding restraining board 22 of the restraining module 20.

Figure 8:
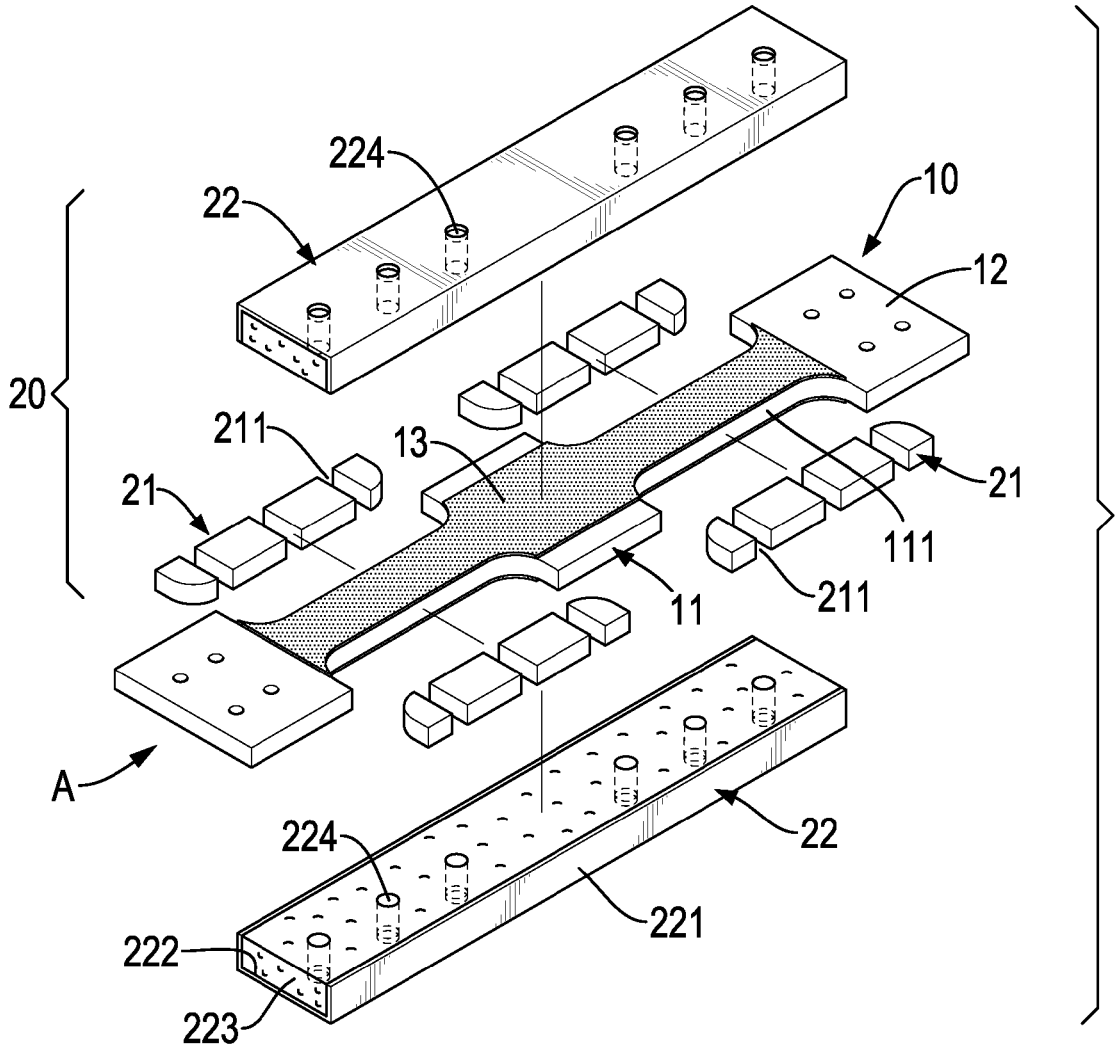
FIG. 8 is an exploded perspective view of a sixth embodiment of a bracing device in accordance with the present invention.
Figure 9:
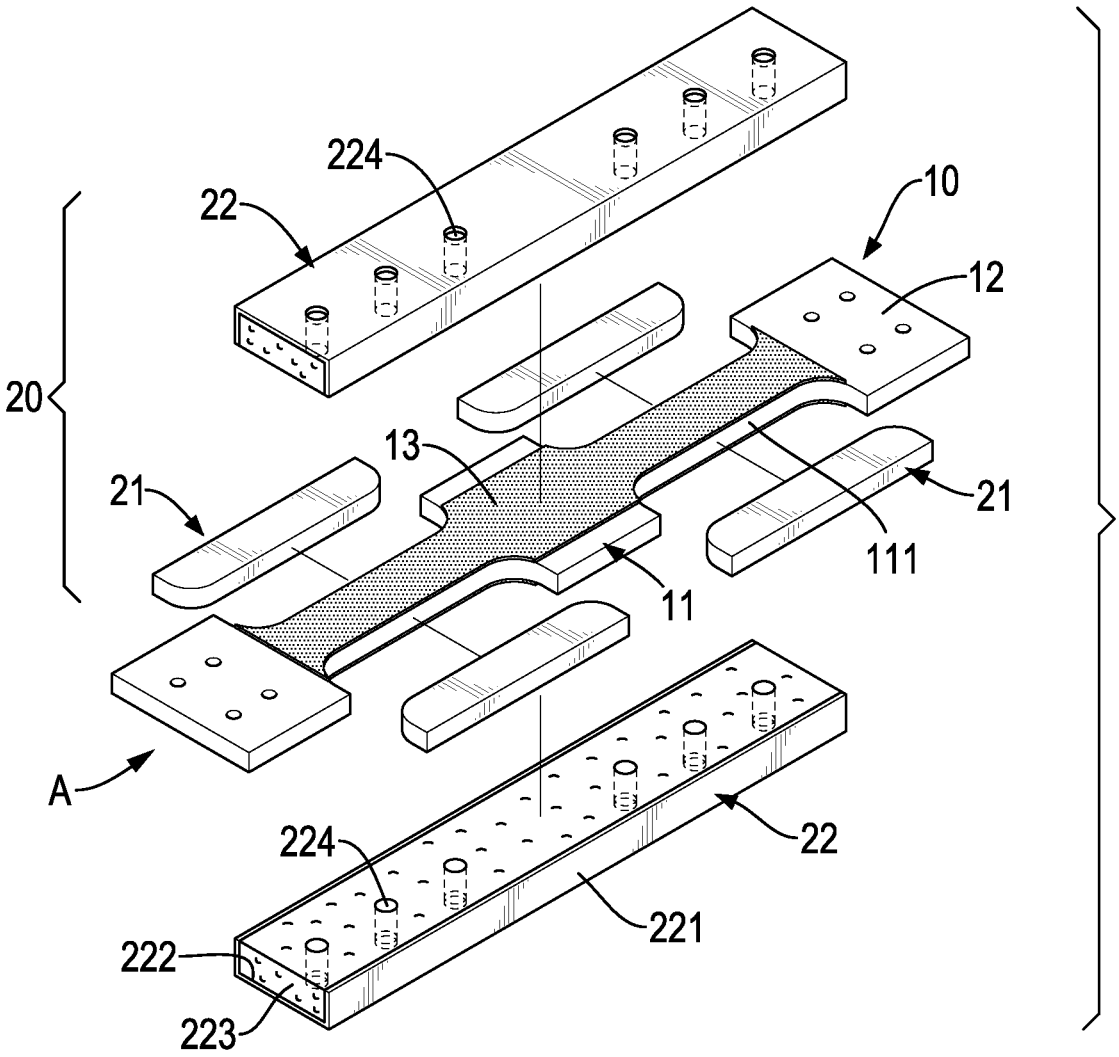
FIG. 9 is an exploded perspective view of a seventh embodiment of a bracing device in accordance with the present invention.
Figure 10:
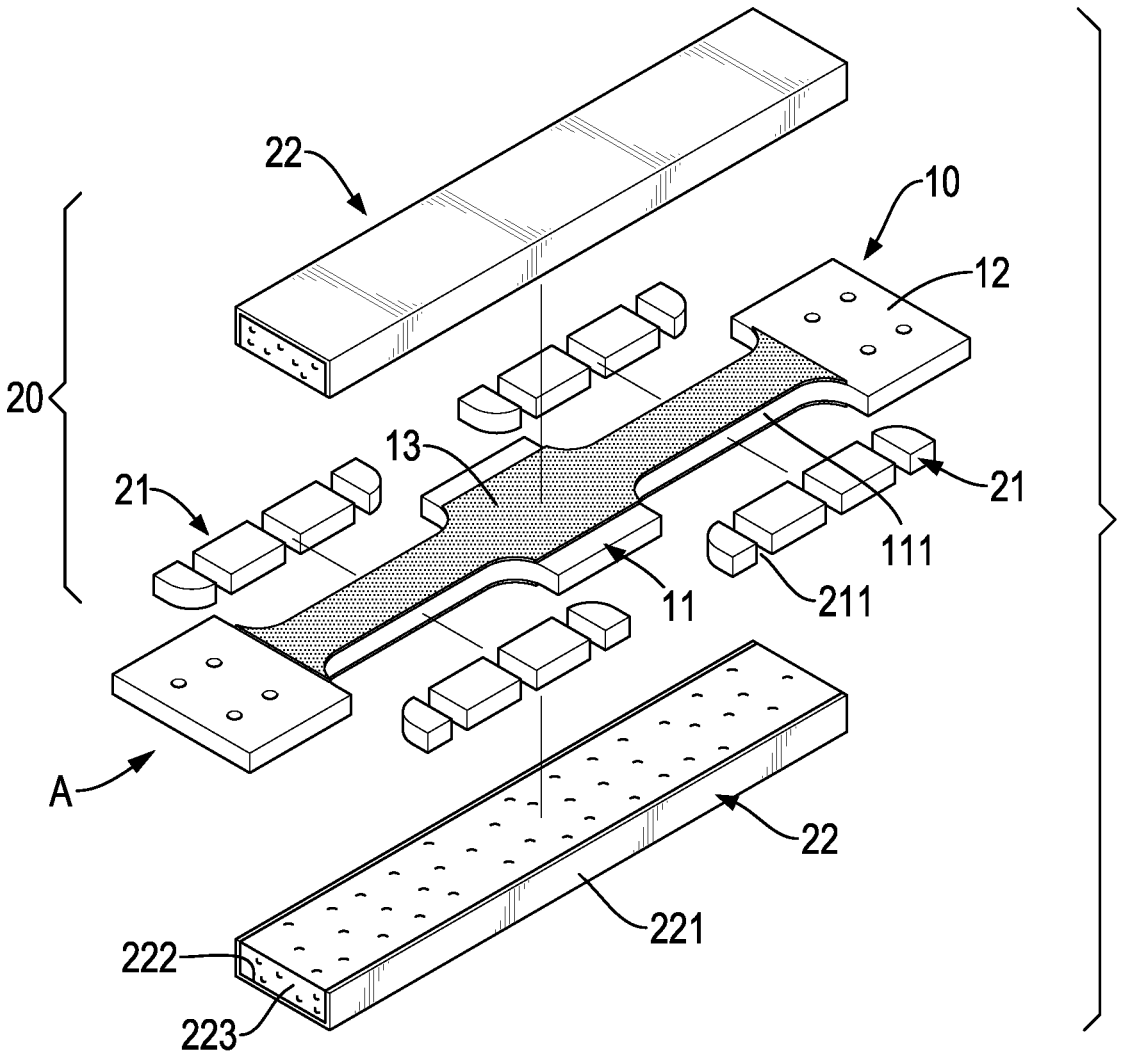
FIG. 10 is an exploded perspective view of an eighth embodiment of a bracing device in accordance with the present invention.

With reference to FIGS. 8 to 10, sixth to eighth embodiments of a bracing device in accordance with the present invention are respectively and substantially the same as the first, second and fourth embodiments in FIGS. 1, 3 and 6 except the following features. The axial segment 11 of the supporting element 10 has four concave edges 111. Two of the concave edges 111 are formed in one of the sidewalls of the axial segment 11 at an interval and the other two concave edges 111 are formed in the other sidewall of the axial segment 11 at an interval. In addition, the straining element 20 has four side boards 21 respectively mounted in the concave edges 111 of the axial segment 11 of the supporting elements 10.

Figure 11:
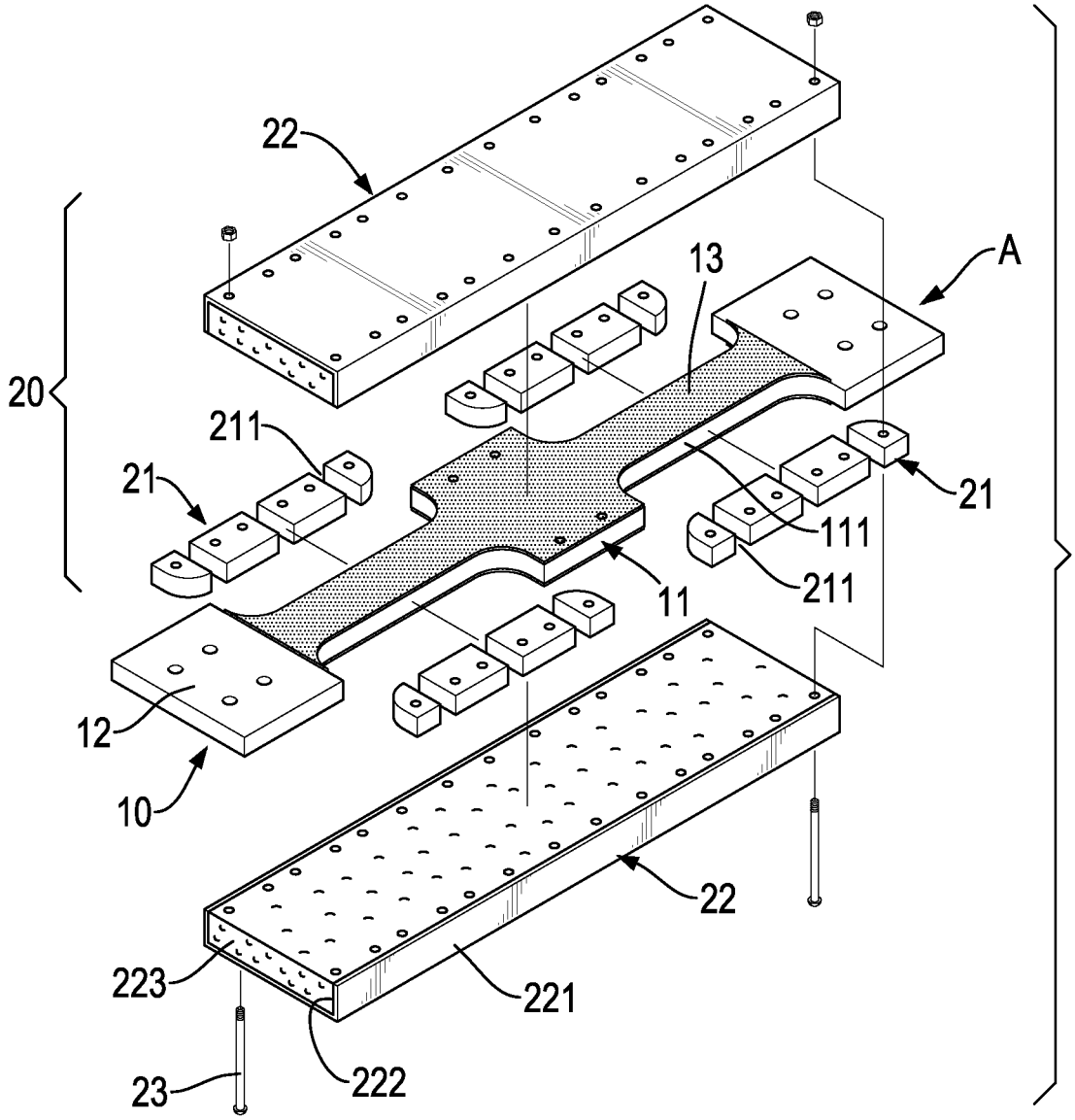
FIG. 11 is an exploded perspective view of a ninth embodiment of a bracing device in accordance with the present invention.

With reference to FIG. 11, a ninth embodiment of a bracing device in accordance with the present invention is substantially the same as the eighth embodiment in FIG. 10 except the following features. The restraining module 20 has multiple through holes and multiple bolts and nuts 23. The through holes are formed through the side boards 21 and the restraining boards 22 at intervals and align with each other. The bolts and nuts 23 are mounted in the through holes of the side boards 21 and the restraining boards 22 to connect the side boards 21 securely with the restraining boards 22.

Figure 12:
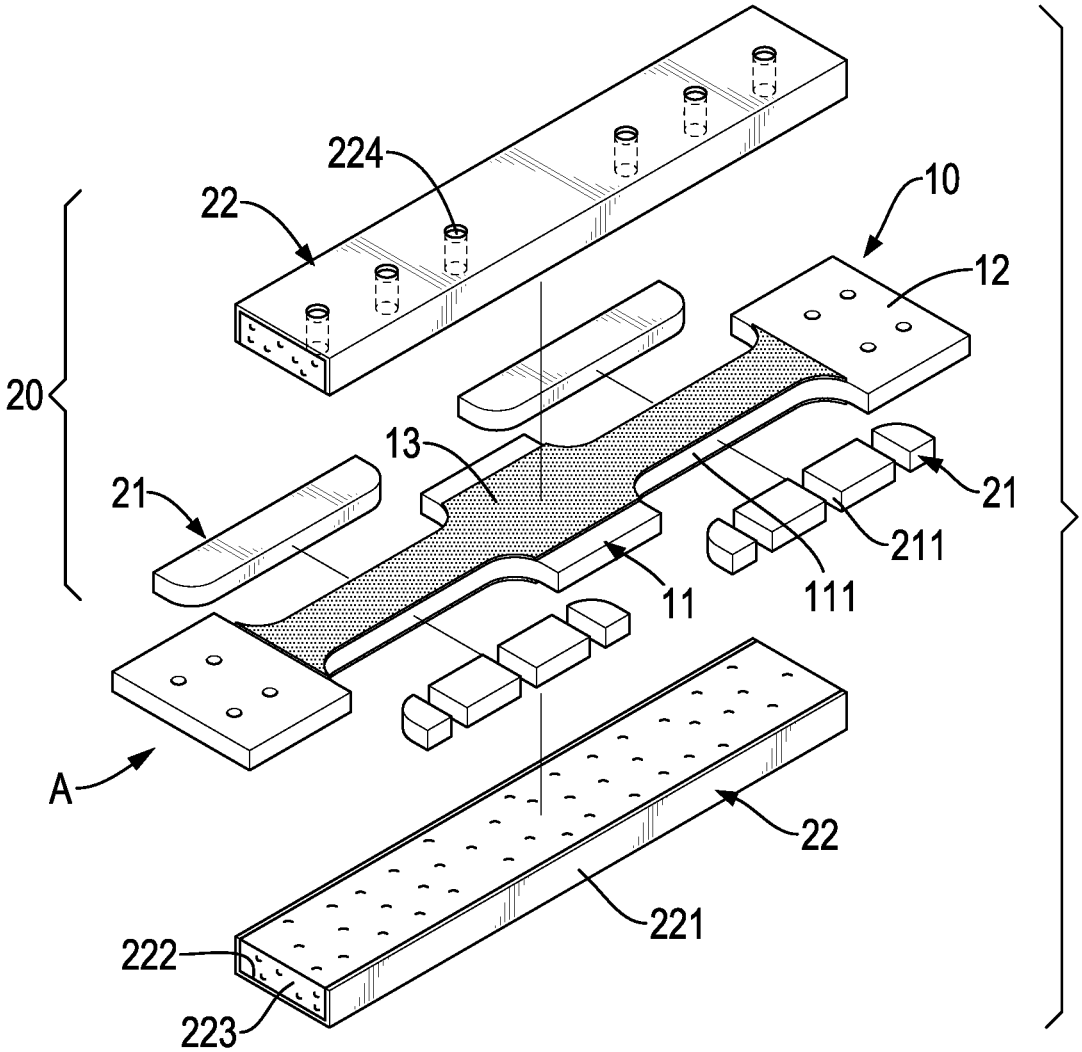
FIG. 12 is an exploded perspective view of a tenth embodiment of a bracing device in accordance with the present invention.

With reference to FIG. 12, a tenth embodiment of a bracing device in accordance with the present invention is substantially the same as the fifth embodiment in FIG. 7 except the following features. The axial segment 11 of the supporting element 10 has four concave edges 111. Two of the concave edges 111 are formed in one of the sidewalls of the axial segment 11 at an interval and the other two concave edges 111 are formed in the other sidewall of the axial segment 11 at an interval. In addition, the straining element 20 has four side boards 21 respectively mounted in the concave edges 111 of the axial segment 11 of the supporting elements 10.

Figure 13:
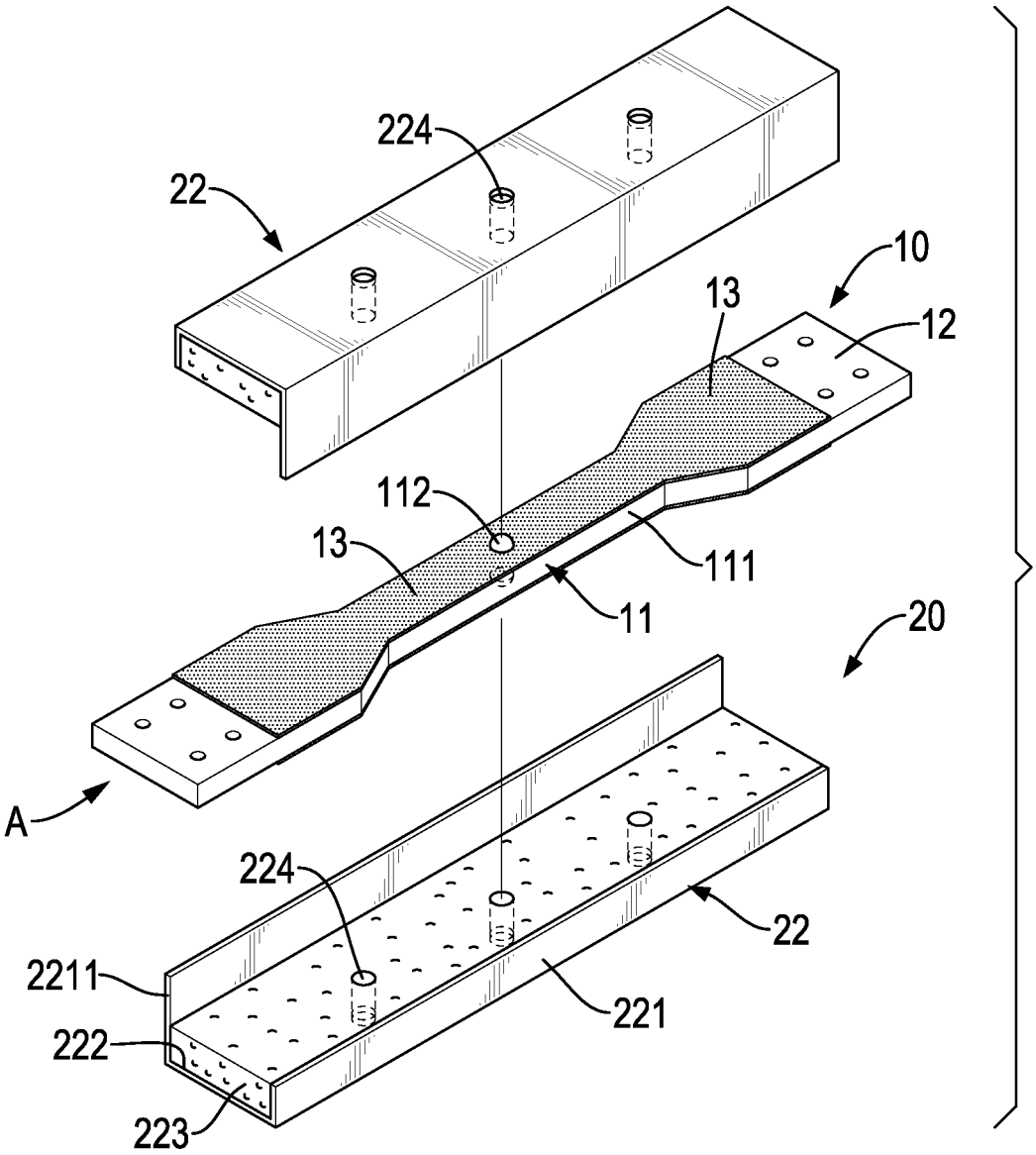
FIG. 13 is an exploded perspective view of an eleventh embodiment of a bracing device in accordance with the present invention.
Figure 14:
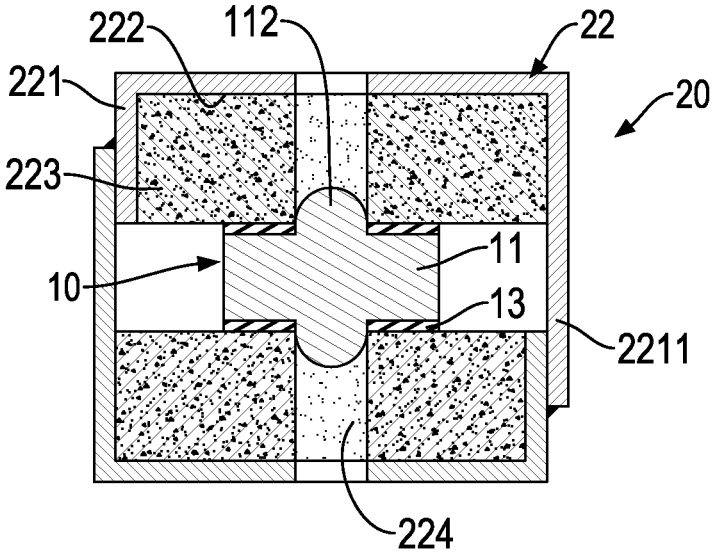
FIG. 14 is an enlarged side view of the bracing device in FIG. 13.

With reference to FIGS. 13 and 14, in an eleventh embodiment of a bracing device in accordance with the present invention, the bracing device has a supporting module A and a restraining module 20 mounted around the supporting module A to provide a restraining-supporting effect to the supporting module A. The supporting module A has an elongated-plate-shaped supporting element 10. The supporting element 10 has an axial segment 11, two connecting heads 12 and two detaching members 13. The axial segment 11 has a first side, a second side, two sidewalls and two connecting ends, two concave edges 111 and two protruding blocks 112. The concave edges 111 are respectively formed in the sidewalls of the axial segment 11. The protruding blocks 112 are respectively formed on and protrude from the first side and the second side of the axial segment 11.

The connecting heads 12 are respectively formed on the connecting ends of the axial segment 11. Each connecting head 12 is flat and has multiple connecting holes formed through the connecting head 12. The detaching members 13 are respectively mounted on the first side and the second side of the axial segment 11, and this can prevent an axial force transferring from the supporting element 10 to the restraining module 20.

The restraining module 20 is mounted around the axial segment 11 of the supporting element 10 and has two restraining boards 22. The restraining boards 22 are mounted on the supporting element 10 and are securely connected to each other by welding to enable the restraining module 20 to mount around the supporting element 10. Each one of the restraining board 22 has a restraining frame 221, a filling member 223 and at least one viewing hole 224. The restraining frame 221 is U-shaped and has an inner side, two sidewalls, a filling recess 222 and an extending panel 2211. The filling recess 222 is formed in the inner side of the restraining frame 221 to face and mount on the axial segment 11 of the supporting element 10. The extending panel 2211 is formed on and protrudes from one of the sidewalls of the restraining frame 221 to extend out of the inner side of the restraining frame 221. In addition, when the restraining frames 221 are mounted on the axial segment 11 of the supporting element 10, the extending panels 2211 of the restraining frames 221 are securely connected to two corresponding sidewalls of the restraining frames 221 by welding, and this can enable the restraining module 20 to mount around the supporting element 10.

The filling member 223 may be made of concrete or cement mortar, is mounted in the filling recess 222 of the restraining frame 221, abuts on the detaching member 13 of the supporting element 10 and engages one of the protruding blocks 112 to prevent the restraining module 20 from moving relative to the supporting element 10. The at least one viewing hole 224 is formed through the restraining frame 221 and the filling member 223 of the restraining board 22 to enable a user to see the axial segment 11 of the supporting element 10.

Figure 15:
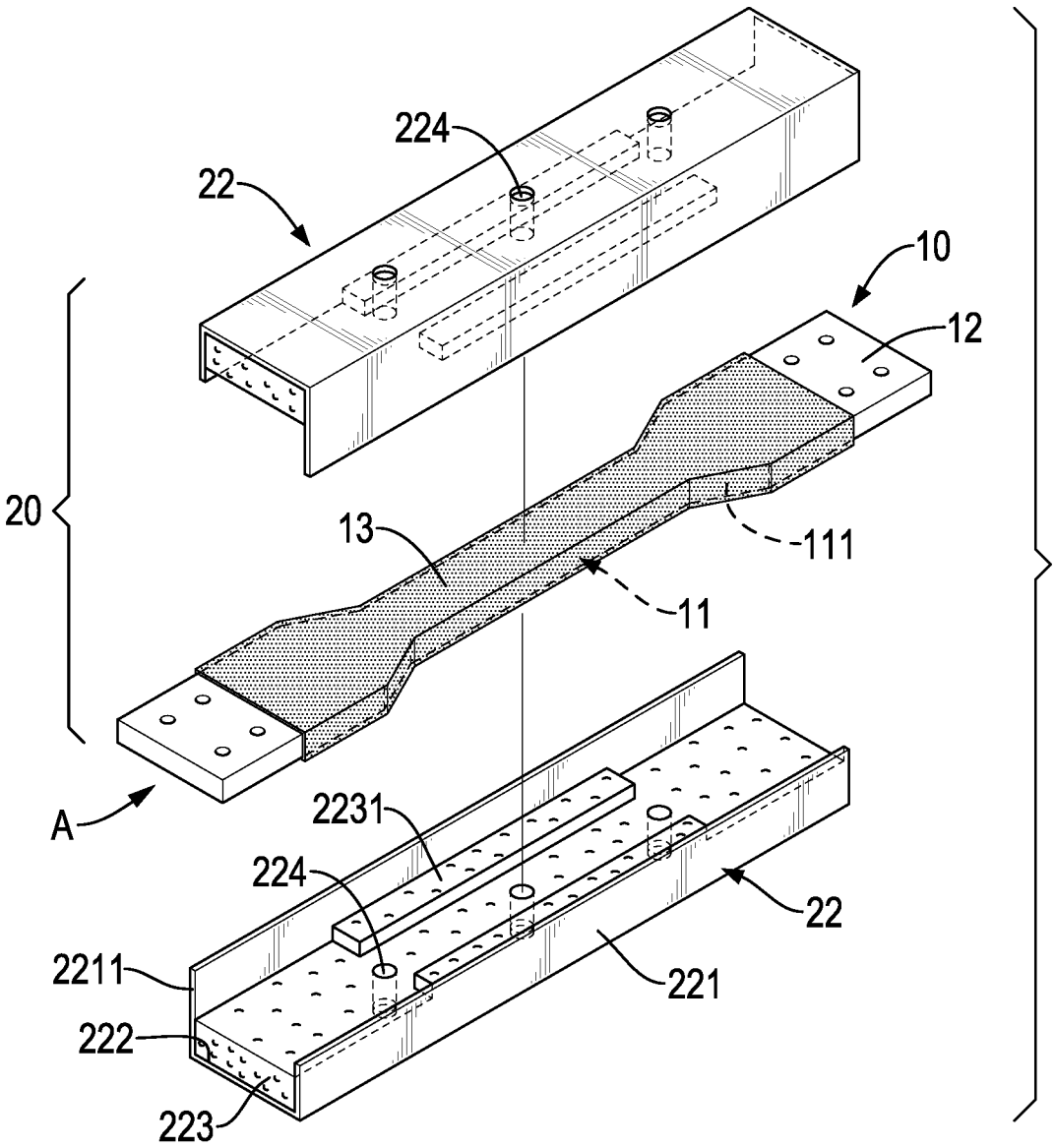
FIG. 15 is an exploded perspective view of a twelfth embodiment of a bracing device in accordance with the present invention.
Figure 16:
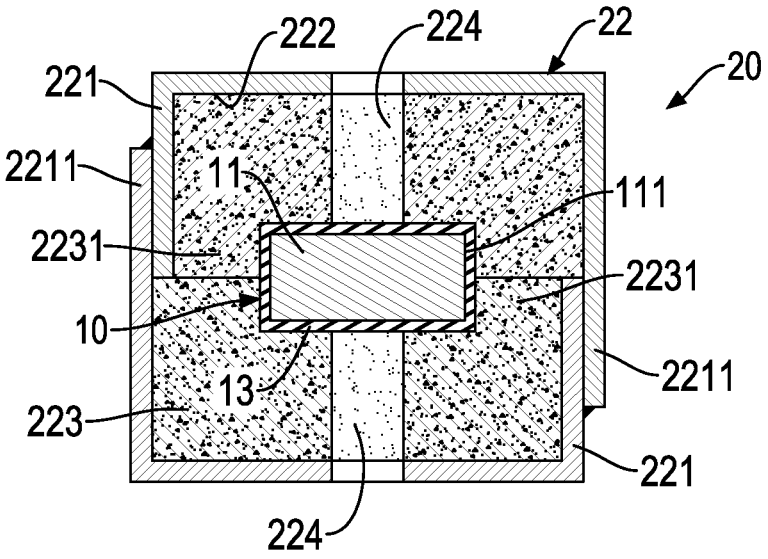
FIG. 16 is an enlarged side view of the bracing device in FIG. 15.

With reference to FIGS. 15 and 16, a twelfth embodiment of a bracing device in accordance with the present invention is substantially the same as the eleventh embodiment in FIG. 13 except the following features. The supporting element 10 has a detaching member 13 mounted around the sidewalls, the first side and the second side of the axial segment 11. In addition, the axial segment 11 does not have the protruding blocks 112. The filling member 223 has an outer side and two engaging segments 2231. The outer side of the filling member 223 abuts on the first side of the axial segment 11 or the second side of the axial segment 11. The engaging segments 2231 are formed on and protrude from the outer side of the filling member 223 and are respectively mounted in and engage the concave edges 111 of the axial segment 11. The engagement between the engaging segments 2231 and the concave edges 111 can prevent the restraining module 20 from moving relative to the supporting element 10.

Figure 17:
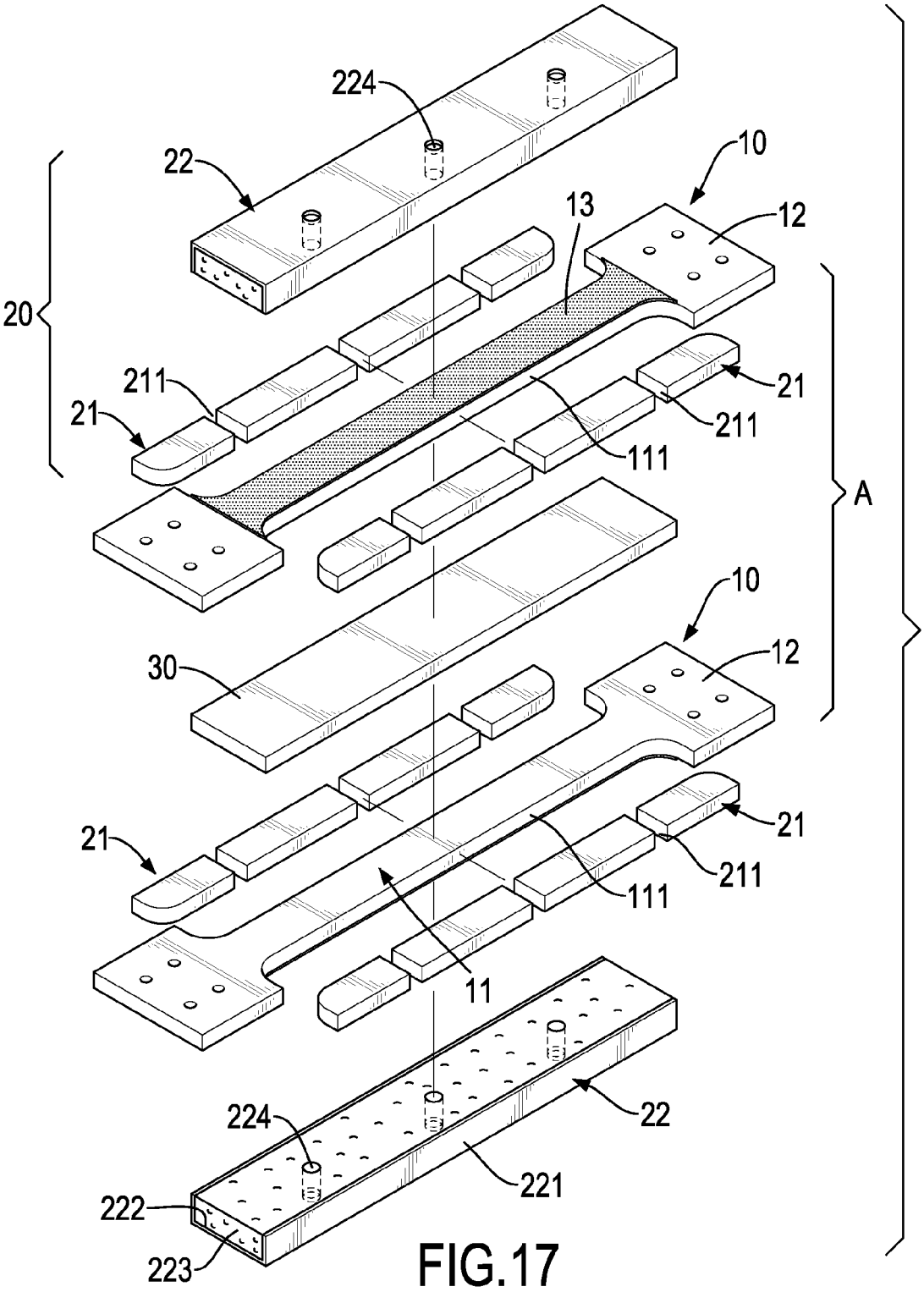
FIG. 17 is an exploded perspective view of a thirteenth embodiment of a bracing device in accordance with the present invention.

With reference to FIG. 17, in a thirteenth embodiment of a bracing device in accordance with the present invention, the bracing device has a supporting module A and a restraining module 20. The supporting module A has a connecting board 30 and two supporting elements 10. The connecting board 30 is elongated-plate-shaped and has a first side and a second side. Furthermore, the connecting board 30 is made of single or multiple layers of metal.

The supporting elements 10 respectively abuts on the first side and the second side of the connecting board 30, and each supporting element 10 has an axial segment 11, two connecting heads 12 and a detaching member 13. The axial segments 11 abuts on the connecting board 30, and each one of the axial segments 11 has a first side, a second side, two sidewalls, two connecting ends and two concave edges 111. The concave edges 111 are nonlinear and are respectively formed in the sidewalls of the axial segment 11. The connecting heads 12 are respectively formed on the connecting ends of the axial segment 11, and each one of the connecting heads 12 has a first side, a second side and multiple connecting holes. The connecting holes are formed through the first side and the second side of the connecting head 12. The detaching member 13 is mounted on the first side or the second side of the axial segment 11 opposite to the connecting board 30.

The restraining module 20 has four side boards 21 and two restraining boards 22. Two of the side boards 21 are mounted in the concave edges 111 of one of the supporting elements 10, and the other two side boards 21 are mounted in the concave edges 111 of the other supporting element 10. In addition, each one of the side boards 21 has three viewing holes 211 formed through the side board 21 at intervals to align with the axial segment 11 of a corresponding supporting element 10.

The restraining boards 22 respectively abut on the detaching member 13 of the supporting elements 10. Each one of the restraining boards 22 has a restraining frame 221, a filling member 223 and three viewing holes 224. The restraining frame 221 is U-shaped and has an inner side and a filling recess 222 formed in the inner side of the restraining frame 221 to face and mount on the axial segment 11 of a corresponding supporting element 10. The filling member 223 is mounted in the filling recess 222 of the restraining frame 221 and abuts on the detaching member 13 of the supporting element 10. The viewing holes 224 are formed through the restraining frames 221 and the filling members 223 of the restraining boards 22 to enable a user to see the axial segments 11 of the supporting elements 10. The side boards 21, the restraining boards 22 and the connecting board 30 are securely connected to each other by welding, fastening or riveting to enable the restraining module 20 to mount around the supporting elements 10.

Figure 18:
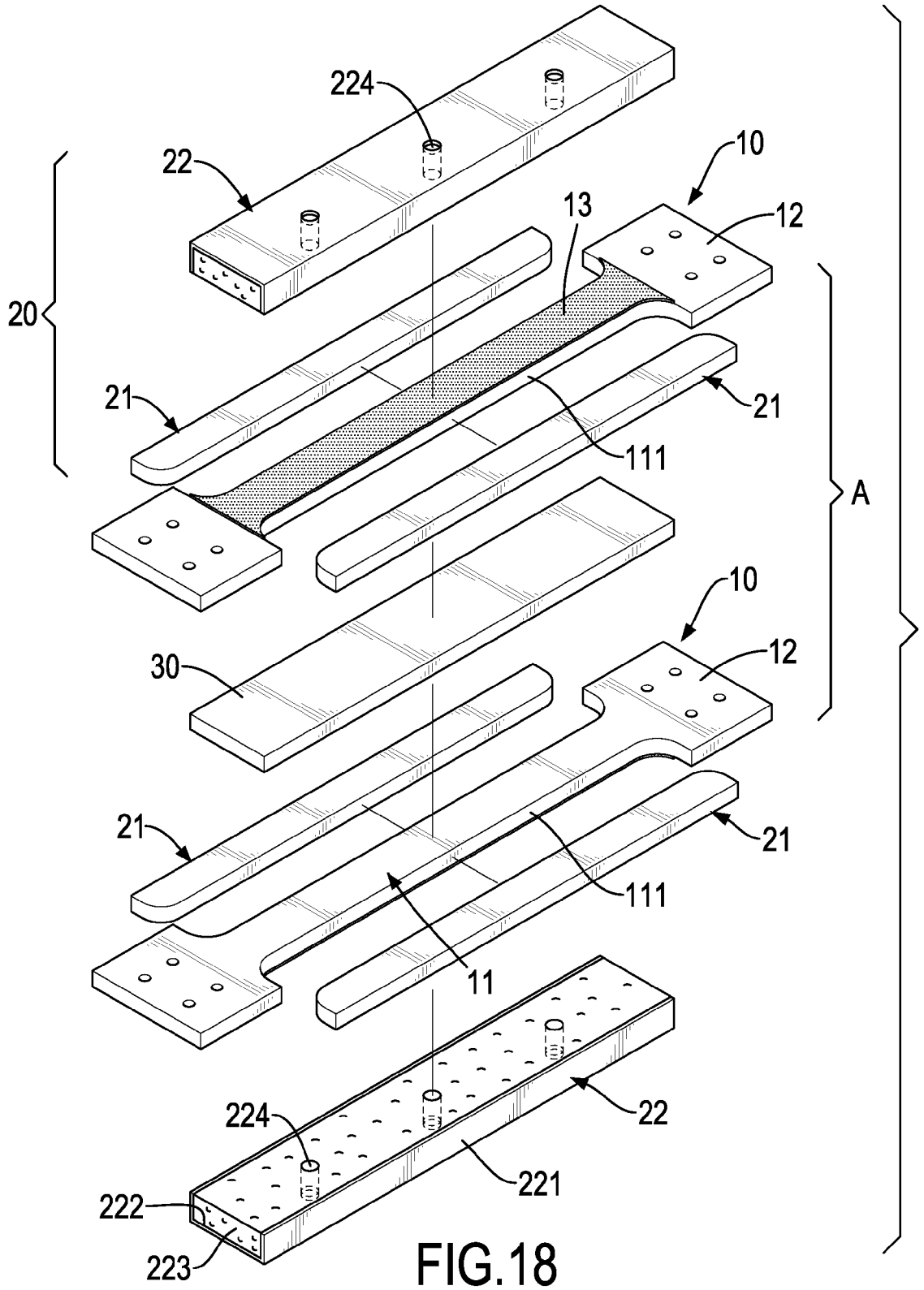
FIG. 18 is an exploded perspective view of a fourteenth embodiment of a bracing device in accordance with the present invention.

With reference to FIG. 18, a fourteenth embodiment of a bracing device in accordance with the present invention is substantially the same as the thirteenth embodiment in FIG. 17 except the following features. The side boards 21 do not have the viewing holes 211. Then, the user can easily see the axial segments 11 of the supporting elements 10 via the viewing holes 224 of the restraining boards 22 of the restraining module 20.

Figure 19:
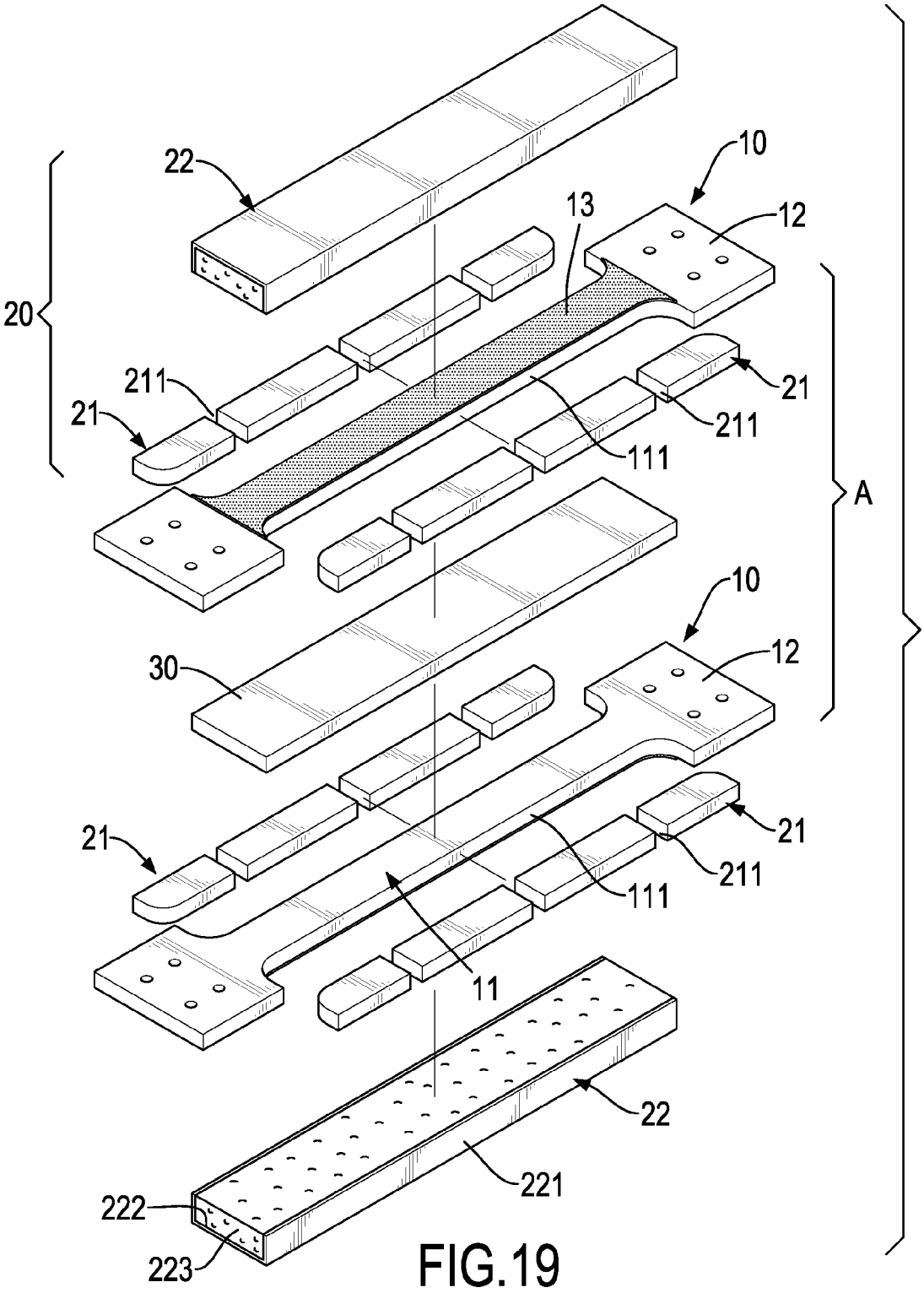
FIG. 19 is an exploded perspective view of a fifteenth embodiment of a bracing device in accordance with the present invention.

With reference to FIG. 19, a fifteenth embodiment of a bracing device in accordance with the present invention is substantially the same as the thirteenth embodiment in FIG.

17 except the following features. The restraining boards 22 do not have the viewing holes 224. Then, the user can easily see the axial segments 11 of the supporting elements 10 via the viewing holes 211 of the side boards 22 of the restraining module 20.

Figure 20:
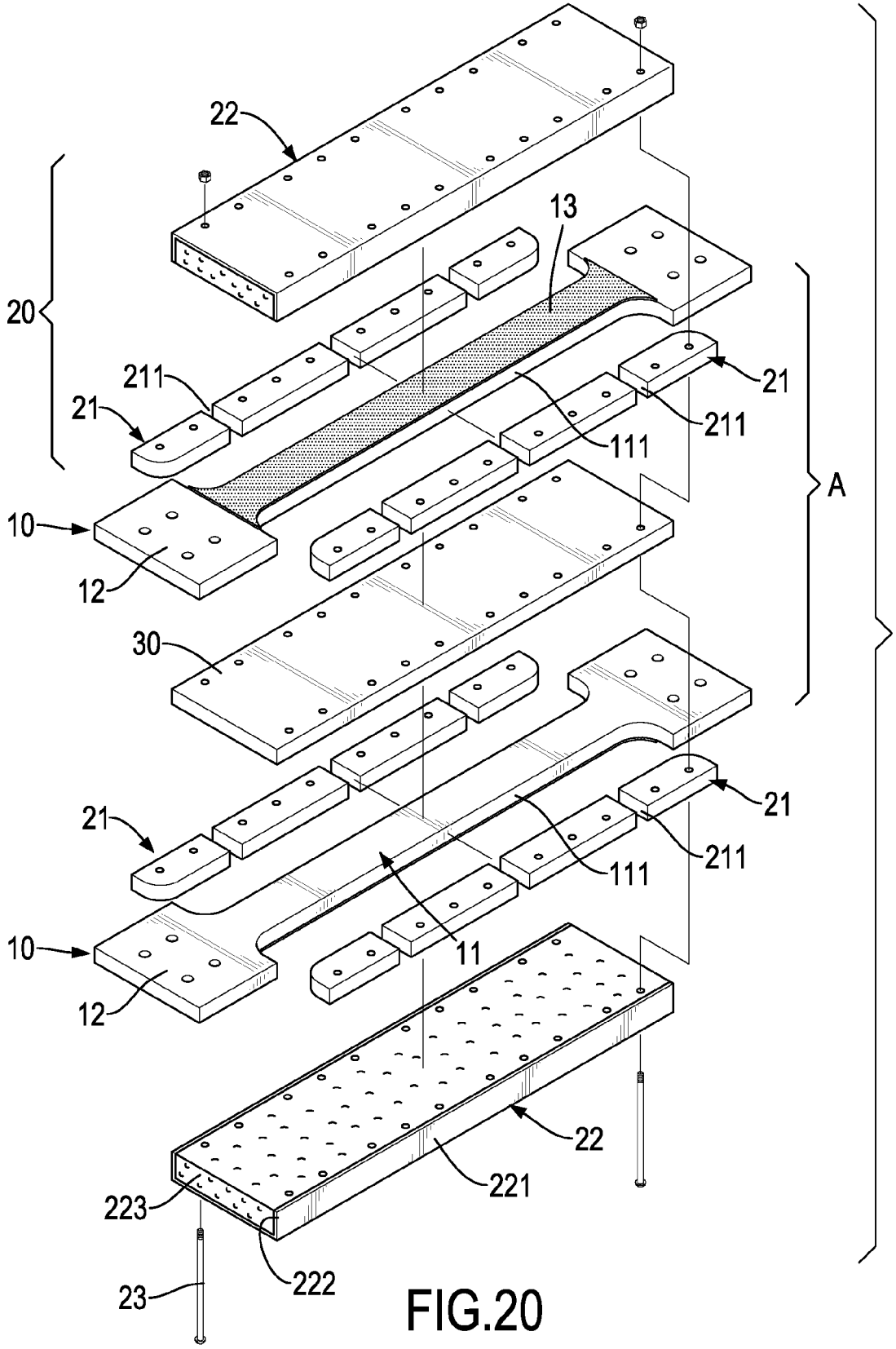
FIG. 20 is an exploded perspective view of a sixteenth embodiment of a bracing device in accordance with the present invention.

With reference to FIG. 20, a sixteenth embodiment of a bracing device in accordance with the present invention is substantially the same as the fifteenth embodiment in FIG. 19 except the following features. The connecting board 30 has multiple through holes formed through the connecting board 30. The restraining module 20 has multiple through holes and multiple bolts and nuts 23. The through holes are formed through the side boards 21 and the restraining boards 22 at intervals and align with each other and the through holes of the connecting board 30. The bolts and nuts 23 are mounted in the through holes of the side boards 21, the restraining boards 22 and the connecting board 30 to connect the side boards 21 and the connecting board 30 securely with the restraining boards 22.

Figure 21:
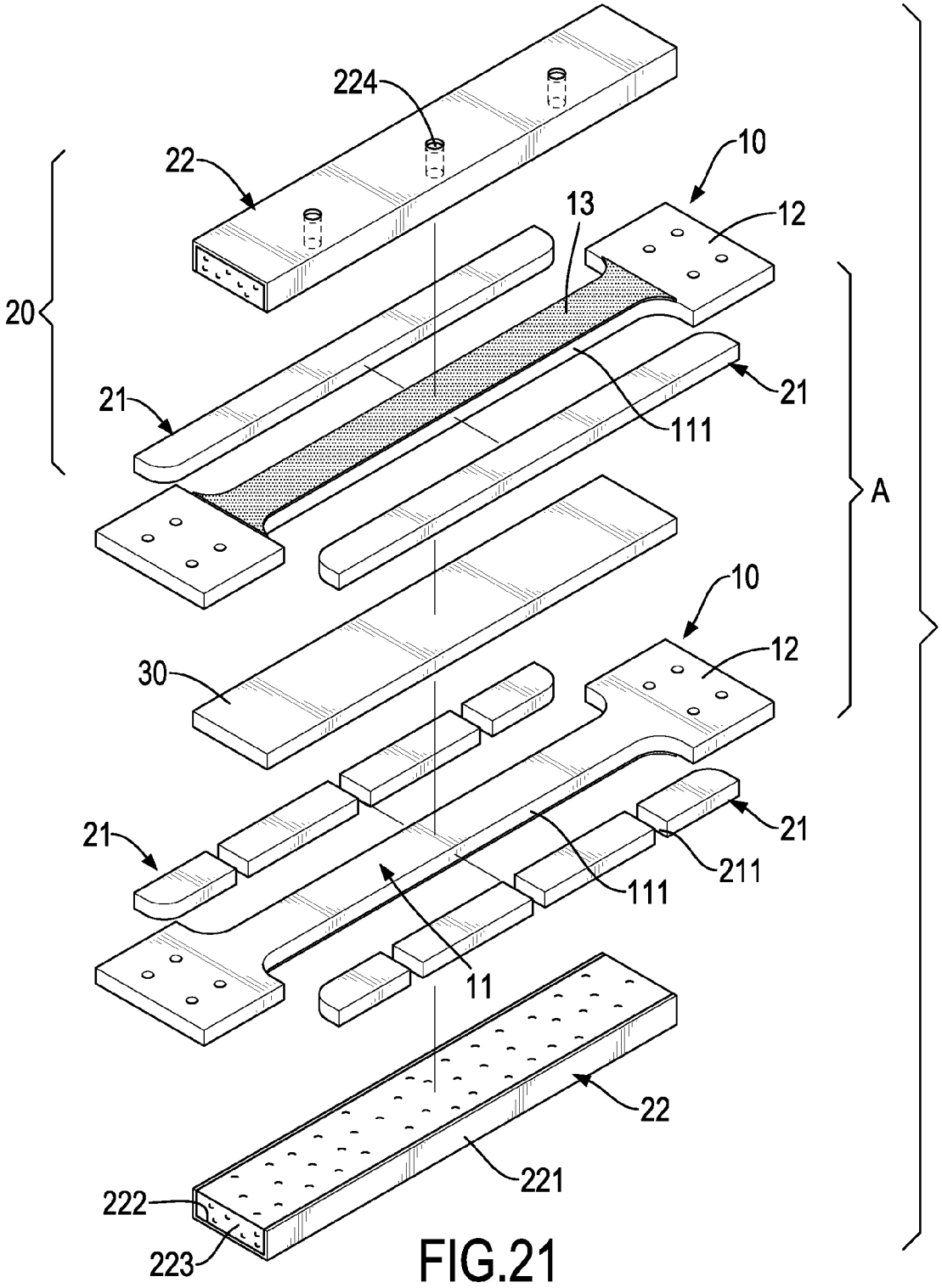
FIG. 21 is an exploded perspective view of a seventeenth embodiment of a bracing device in accordance with the present invention.
Figure 22:
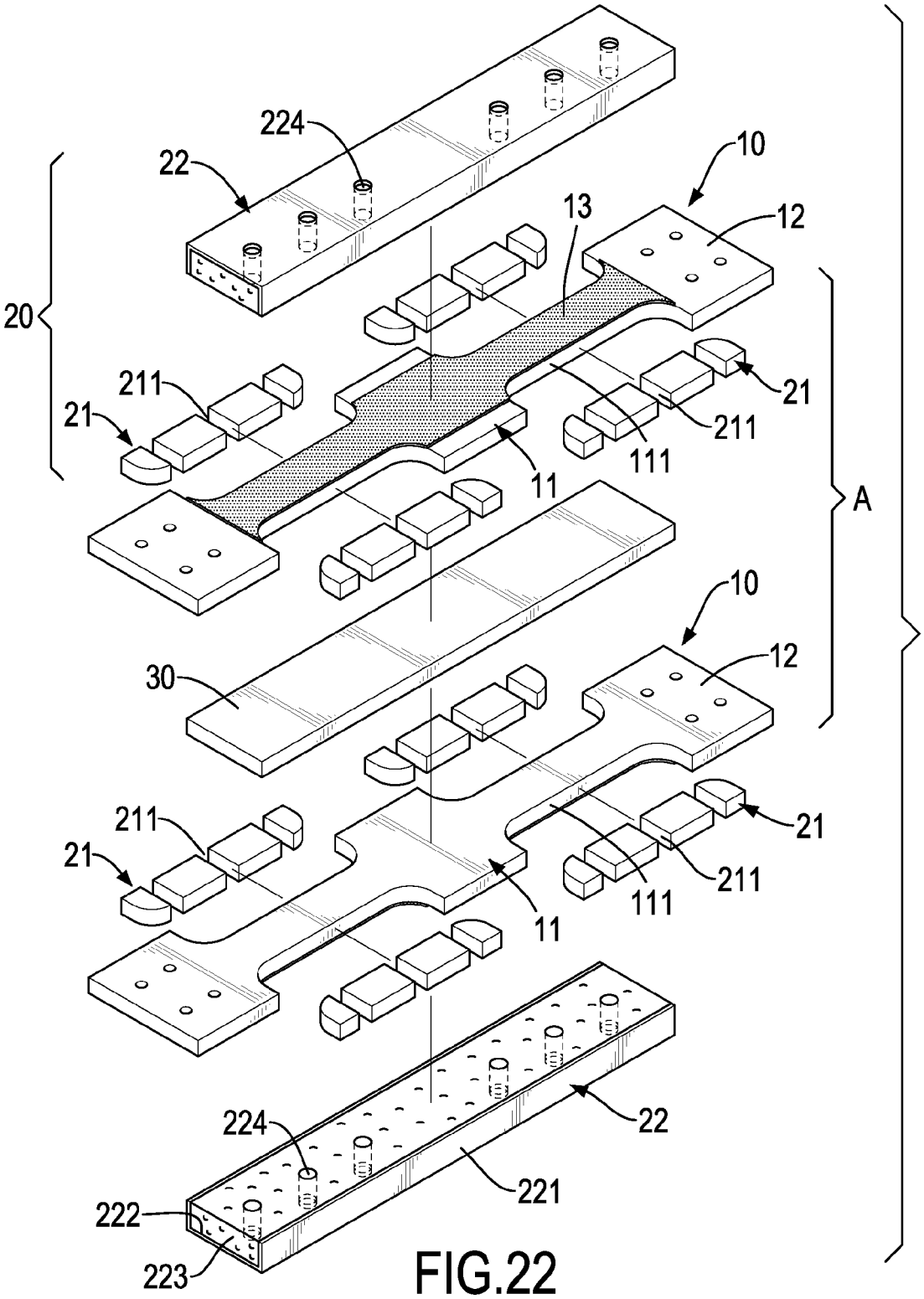
FIG. 22 is an exploded perspective view of an eighteenth embodiment of a bracing device in accordance with the present invention.
Figure 23:
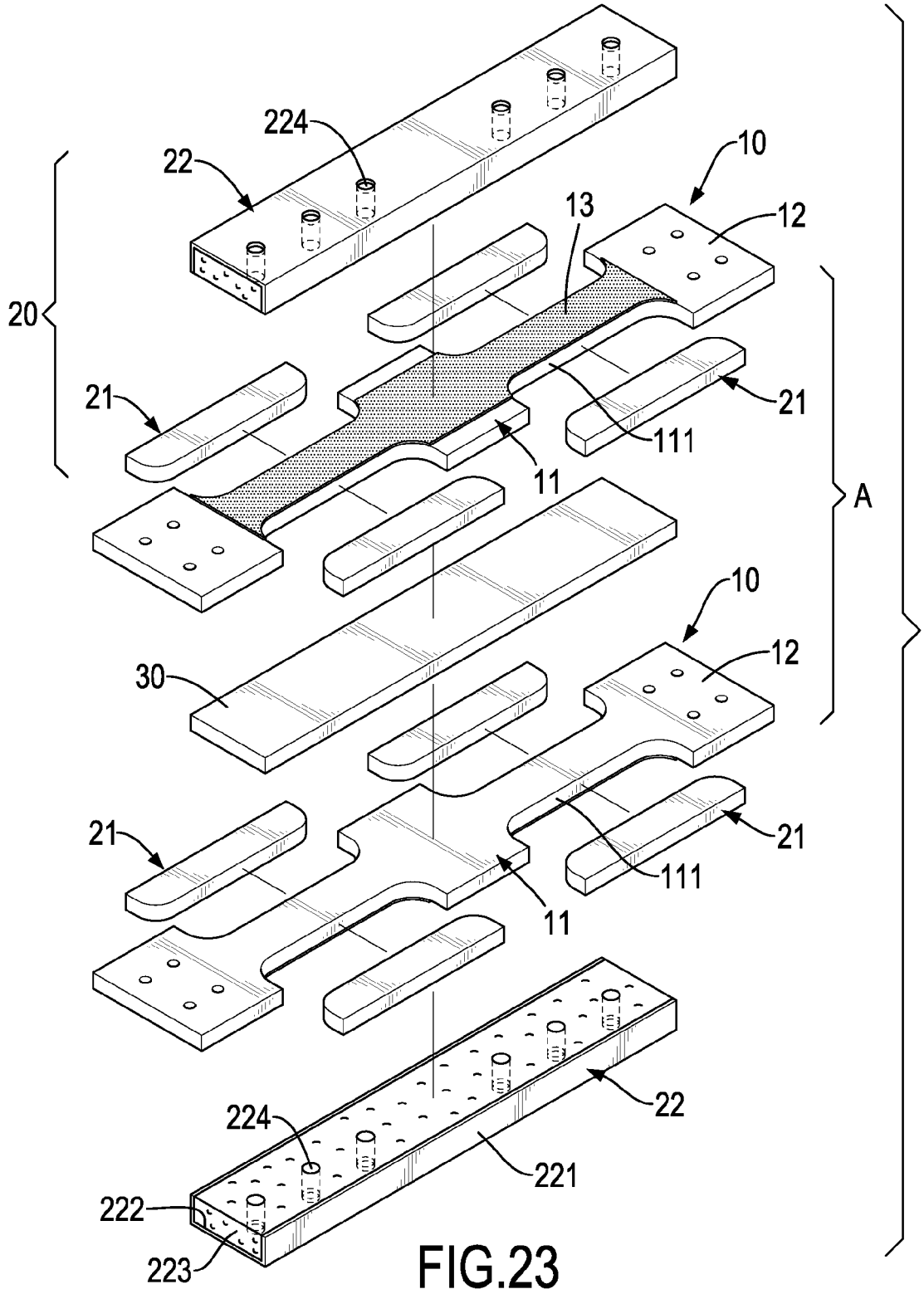
FIG. 23 is an exploded perspective view of a nineteenth embodiment of a bracing device in accordance with the present invention.
Figure 24:
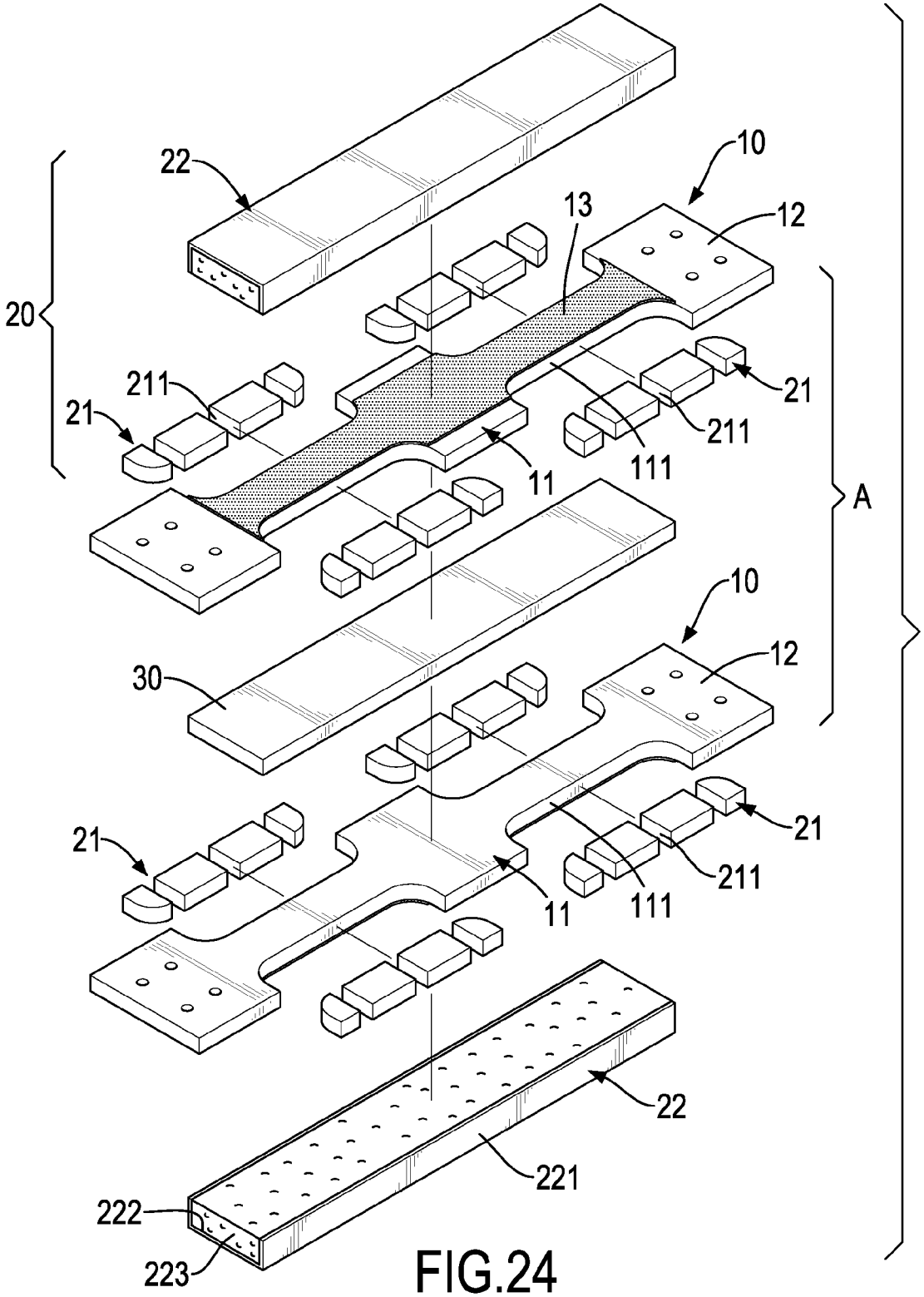
FIG. 24 is an exploded perspective view of a twentieth embodiment of a bracing device in accordance with the present invention.
Figure 25:
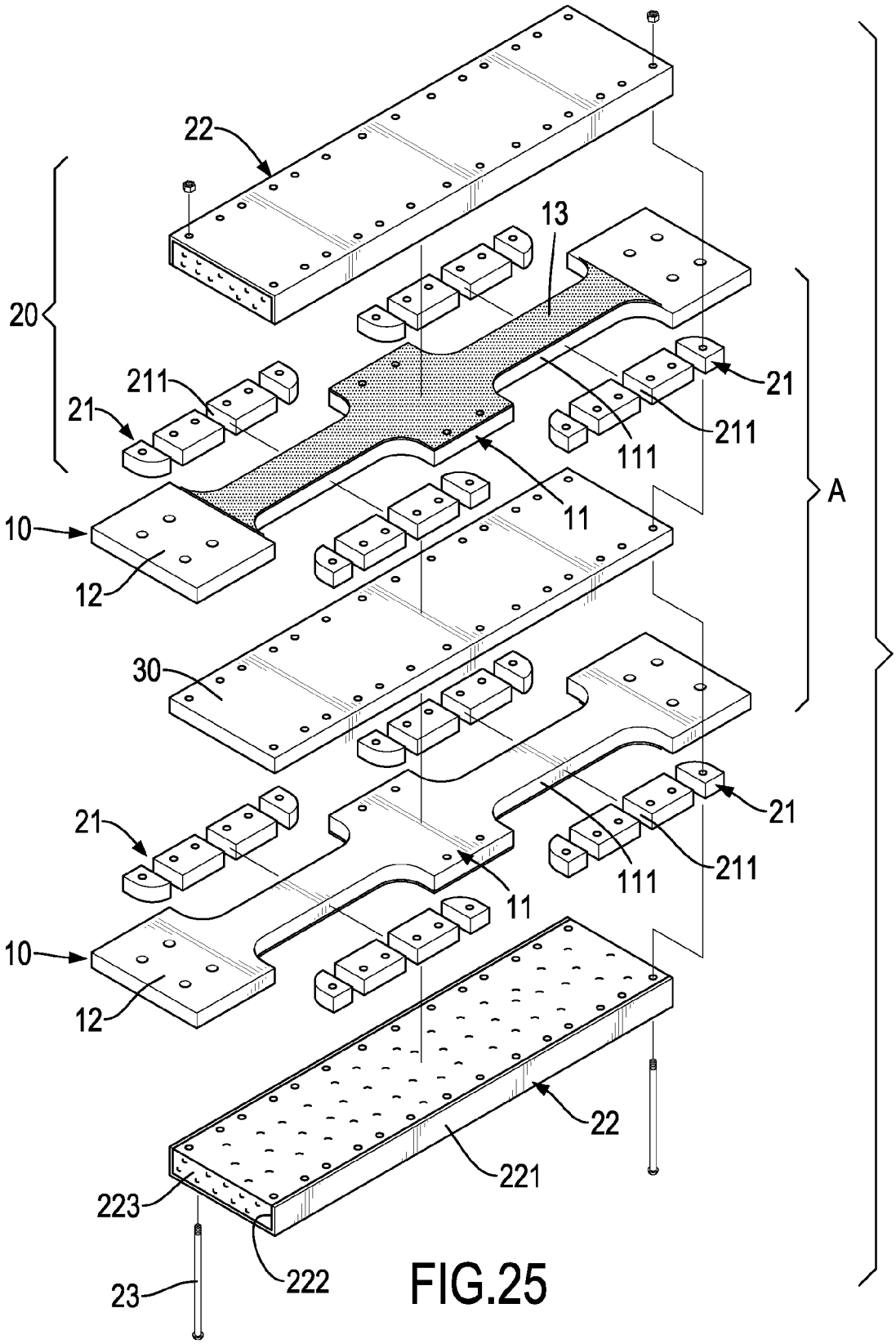
FIG. 25 is an exploded perspective view of a twenty-first embodiment of a bracing device in accordance with the present invention.
Figure 26:
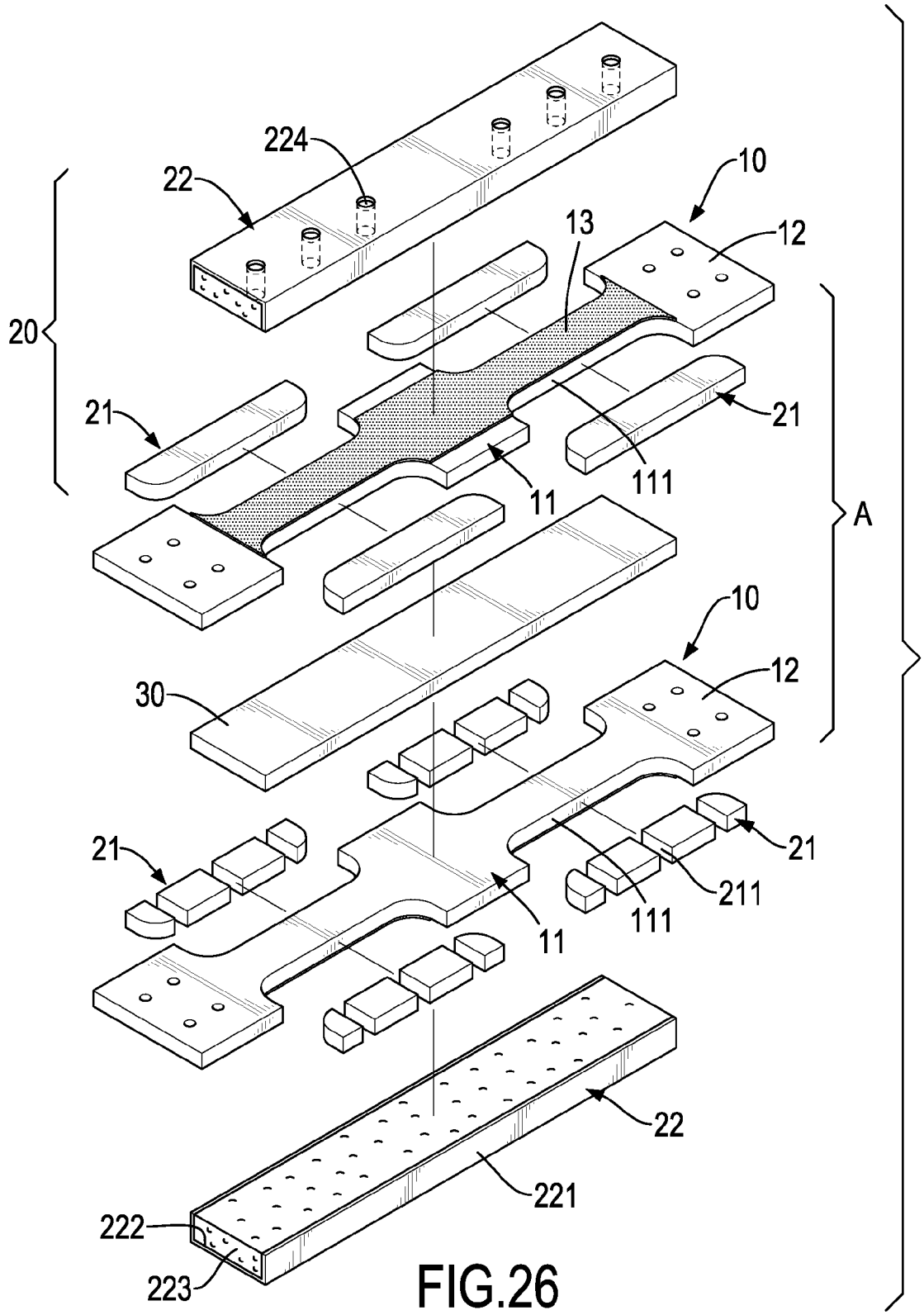
FIG. 26 is an exploded perspective view of a twenty-second embodiment of a bracing device in accordance with the present invention.

With reference to FIG. 21, a seventeenth embodiment of a bracing device in accordance with the present invention is substantially the same as the thirteenth embodiment in FIG. 17 except the following features. Each one of the side boards 21 that are mounted in one of the supporting elements 10 has three viewing holes 211 formed through the side board 21 at intervals to align the axial segment 11 of the corresponding supporting element 10, and one of the restraining boards 22 that is mounted on the other supporting element 10 has three viewing holes 224 formed through the restraining board 22 to align with the axial segment 11 of the corresponding supporting element 10. Then, the user can easily see the axial segments 11 of the supporting elements 10 via the viewing holes 211 of a corresponding side board 21 and the viewing holes 224 of a corresponding restraining board 22 of the restraining element 20.

With reference to FIGS. 22 to 26, eighteenth to twenty-second embodiments of a bracing device in accordance with the present invention are respectively and substantially the same as the thirteenth to seventeenth embodiments in FIGS. 17 to 21 except the following features. The axial segment 11 of each one of the supporting element 10 has four concave edges 111. Two of the concave edges 111 are formed in one of the sidewalls of the axial segment 11 at an interval and the other two concave edges 111 are formed in the other sidewall of the axial segment 11 at an interval. In addition, the restraining module 20 has four side boards 21 respectively mounted in the concave edges 111 of the axial segment 11 of each one of the supporting elements 10.

With reference to FIGS. 27 to 31, twenty-third to twenty-seventh embodiments of a bracing device in accordance with the present invention are respectively and substantially the same as the eighteenth to twenty-second embodiments in FIGS. 22 to 26 except the following features. The axial segment 11 of each one of the supporting elements 10 has a T-shaped cross section, and each one of the connecting heads 12 of the connecting supporting element 10 has an protruding rib 121 formed on and protruding from the connecting head 12 to corresponding with the T-shaped cross section of the axial segment 11 of the corresponding supporting element 10, and this enable the corresponding supporting element 10 to have a T-shaped cross section. The filling member 223 of each one of the restraining boards 22 has an engaging recess 2232 formed in the filling member 223 to mount on the T-shaped cross section of the axial segment 11 of a corresponding supporting element 10 between the protruding ribs 121 of the connecting heads 12 of the corresponding supporting element 10. Then, the restraining boards 22 can be respectively and securely mounted on the supporting elements 10 by the engagement between the axial segments 11 and the engaging recesses 2232.

Figure 27:
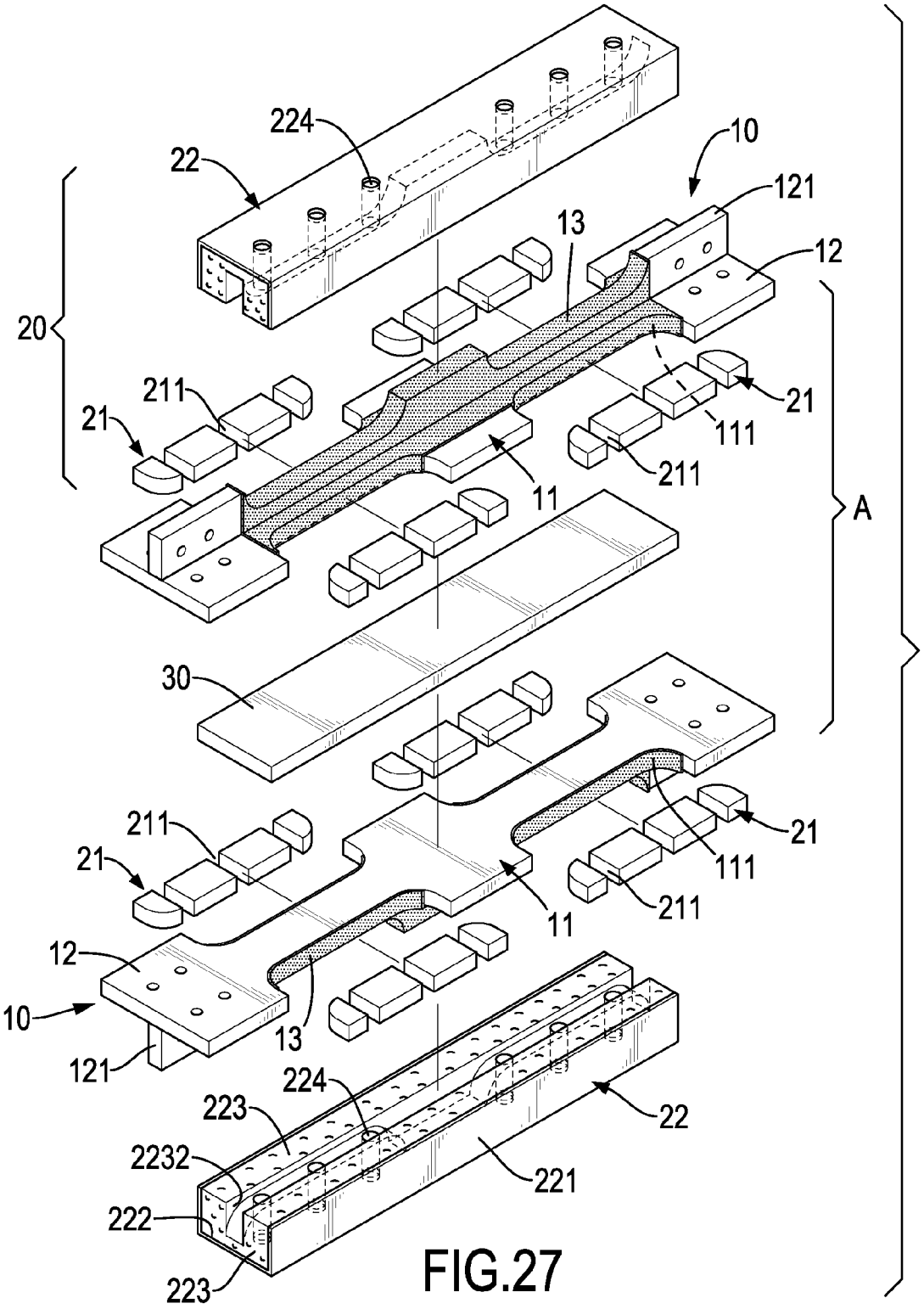
FIG. 27 is an exploded perspective view of a twenty-third embodiment of a bracing device in accordance with the present invention.
Figure 28:
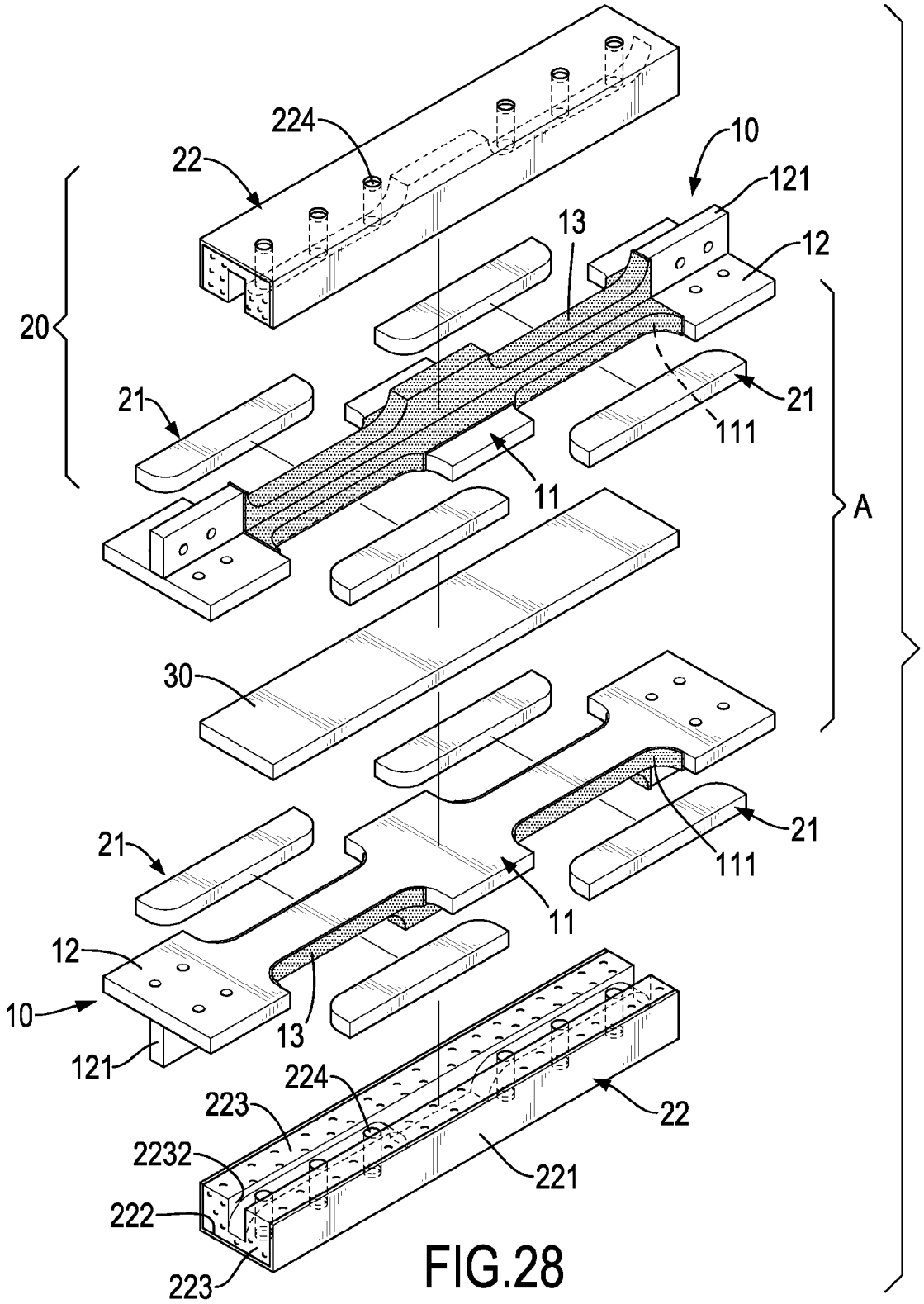
FIG. 28 is an exploded perspective view of a twenty-fourth embodiment of a bracing device in accordance with the present invention.
Figure 29:
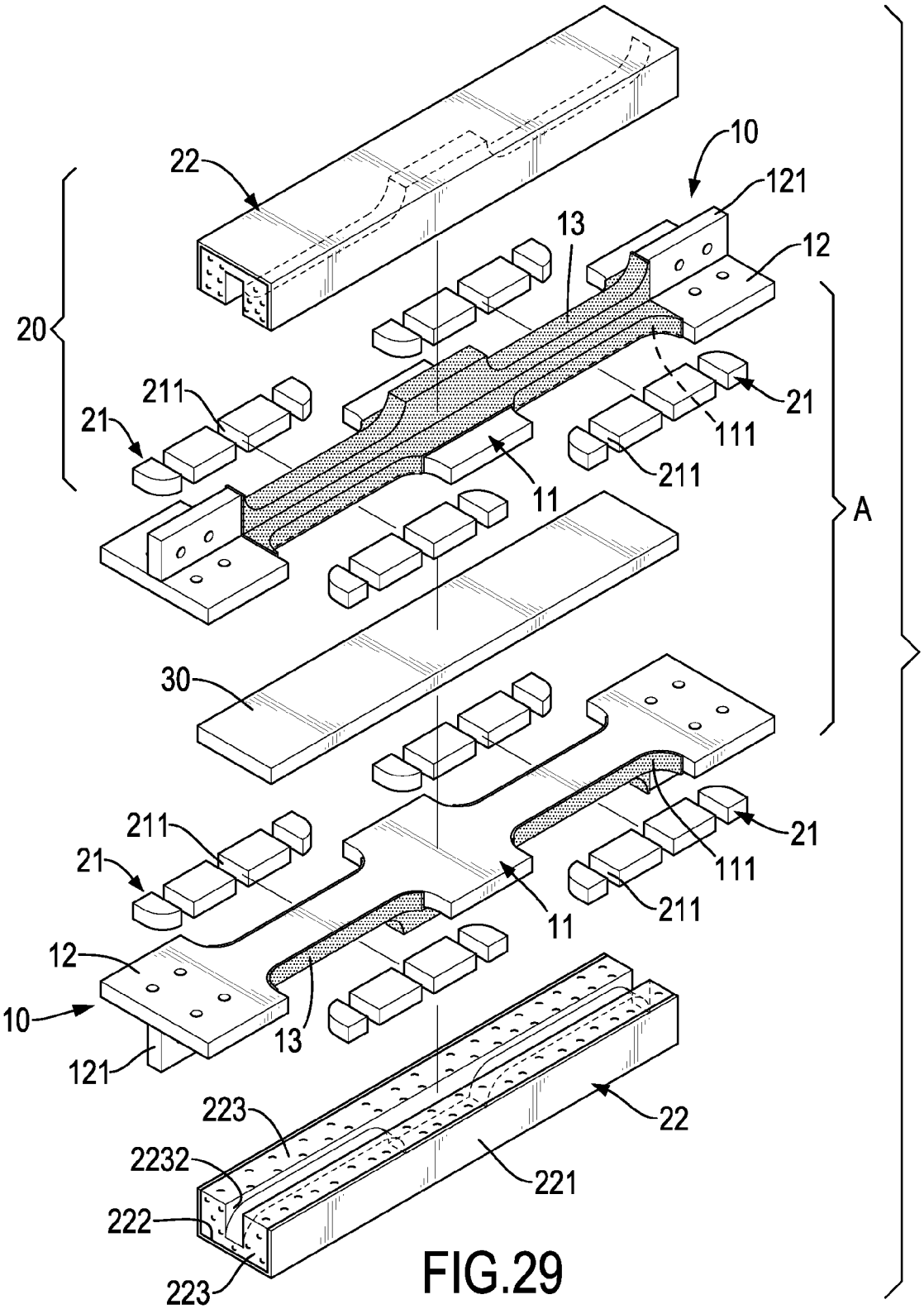
FIG. 29 is an exploded perspective view of a twenty-fifth embodiment of a bracing device in accordance with the present invention.
Figure 30:
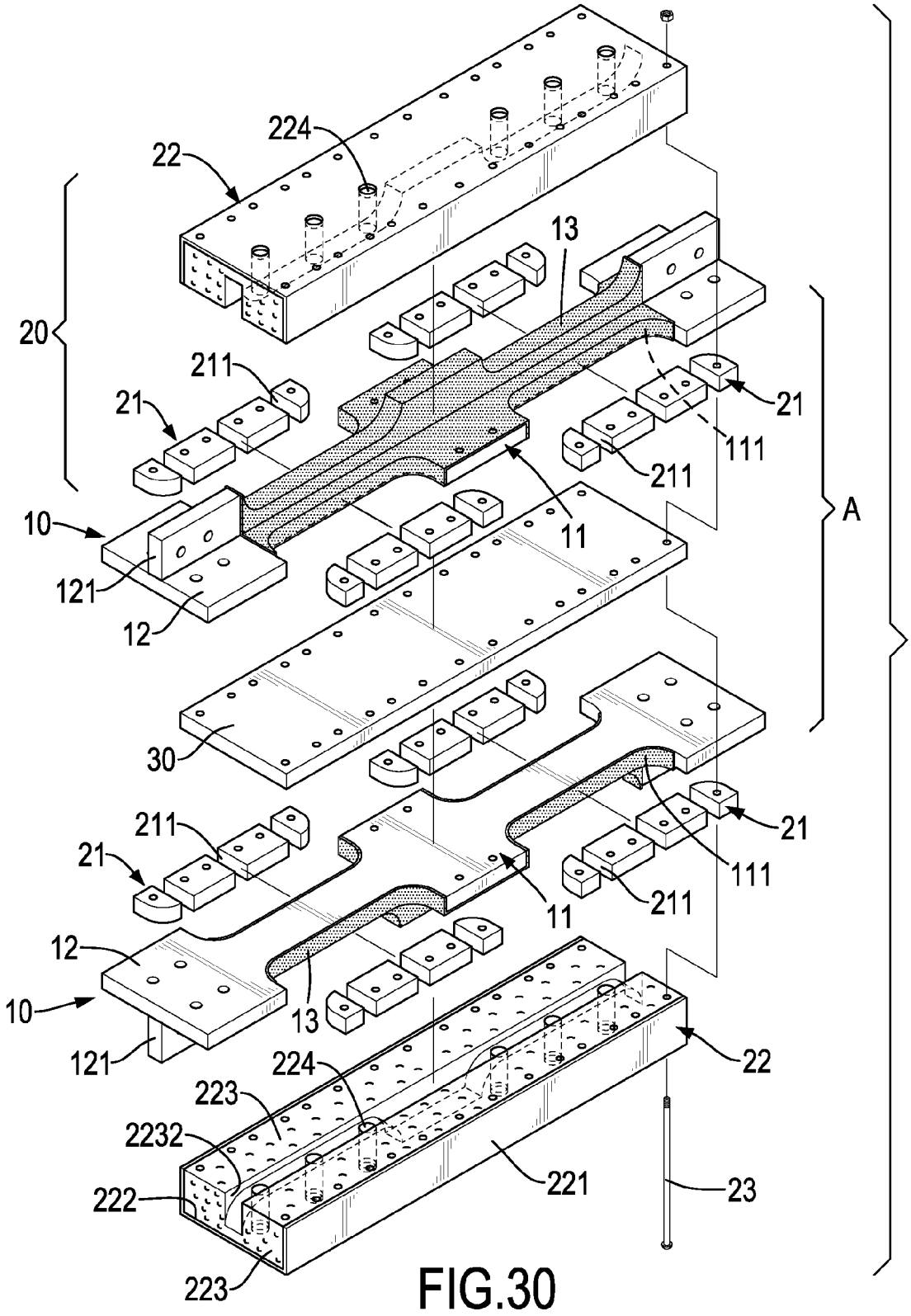
FIG. 30 is an exploded perspective view of a twenty-sixth embodiment of a bracing device in accordance with the present invention.
Figure 31:
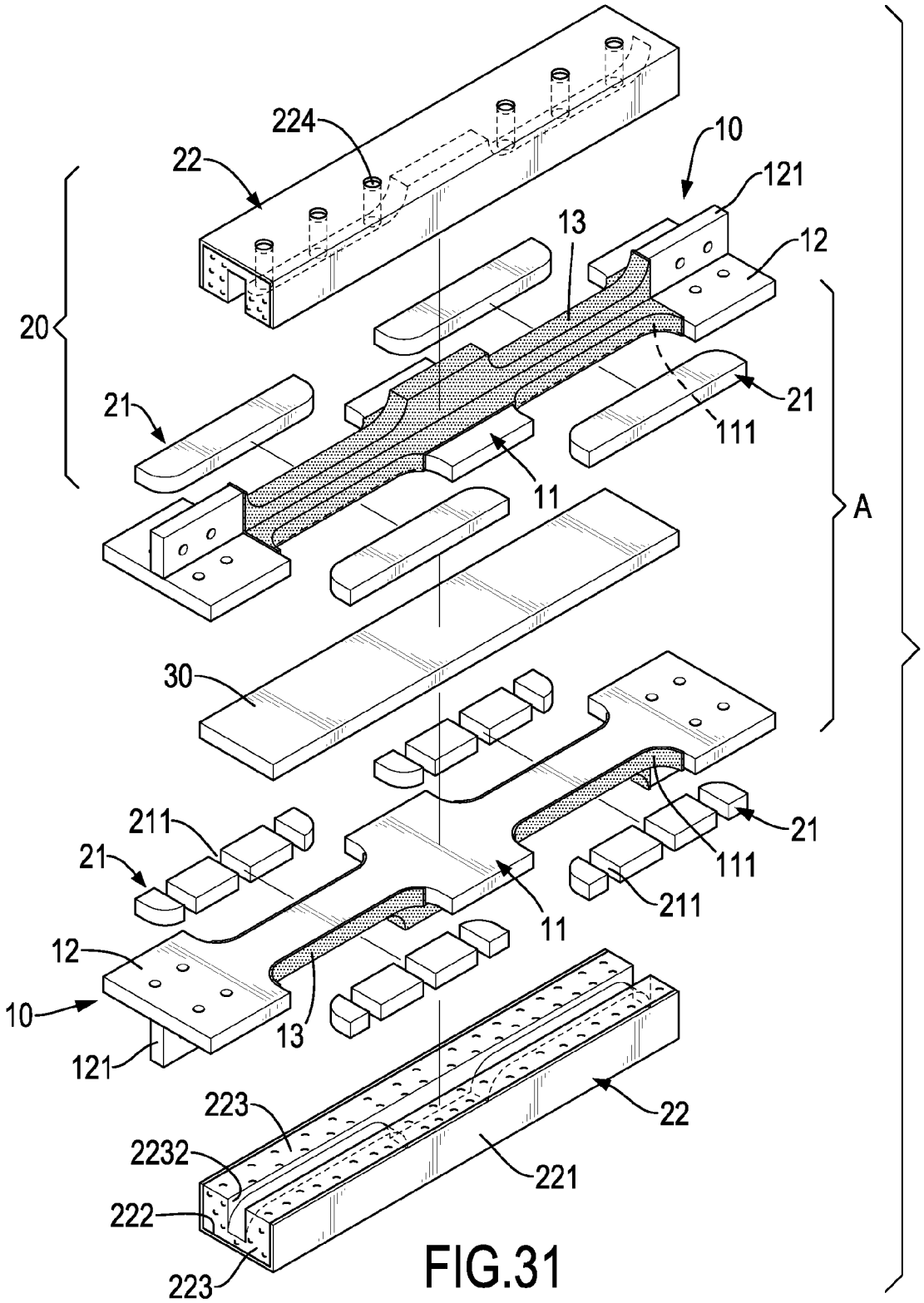
FIG. 31 is an exploded perspective view of a twenty-seventh embodiment of a bracing device in accordance with the present invention.
Figure 32:
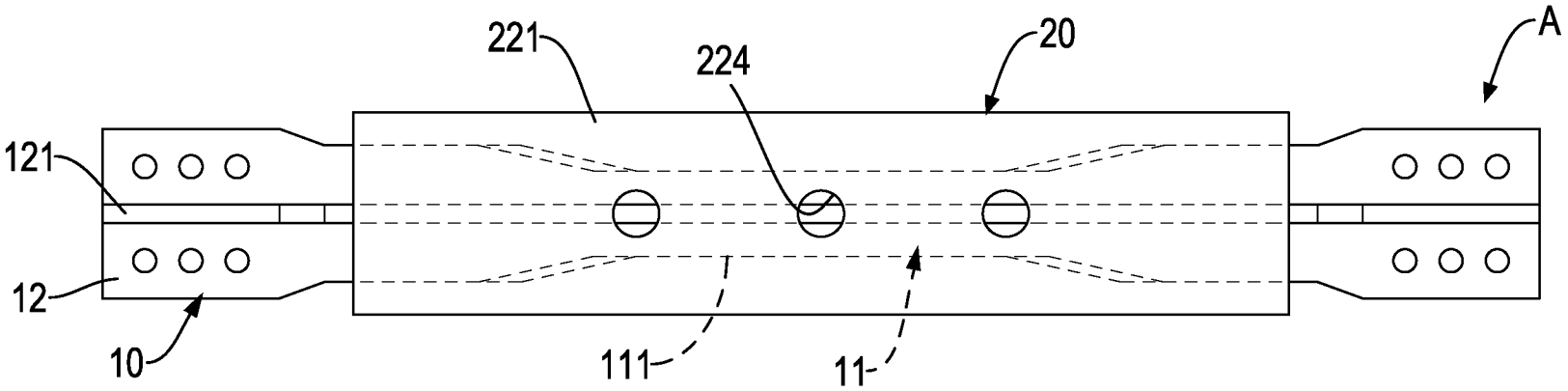
FIG. 32 is a top view of a twenty-eighth embodiment of a bracing device in accordance with the present invention.

With reference to FIG. 32, a twenty-eighth embodiment of a bracing device in accordance with the present invention is substantially the same as the twenty-third embodiment in FIG. 27 except the following features. The axial segment 11 of each one of the supporting elements 10 only has two concave edges 111, and the two concave edges 111 are respectively formed in the sidewalls of the axial segment 11. In addition, the restraining module 20 does not have the side boards 21.

Figure 33:
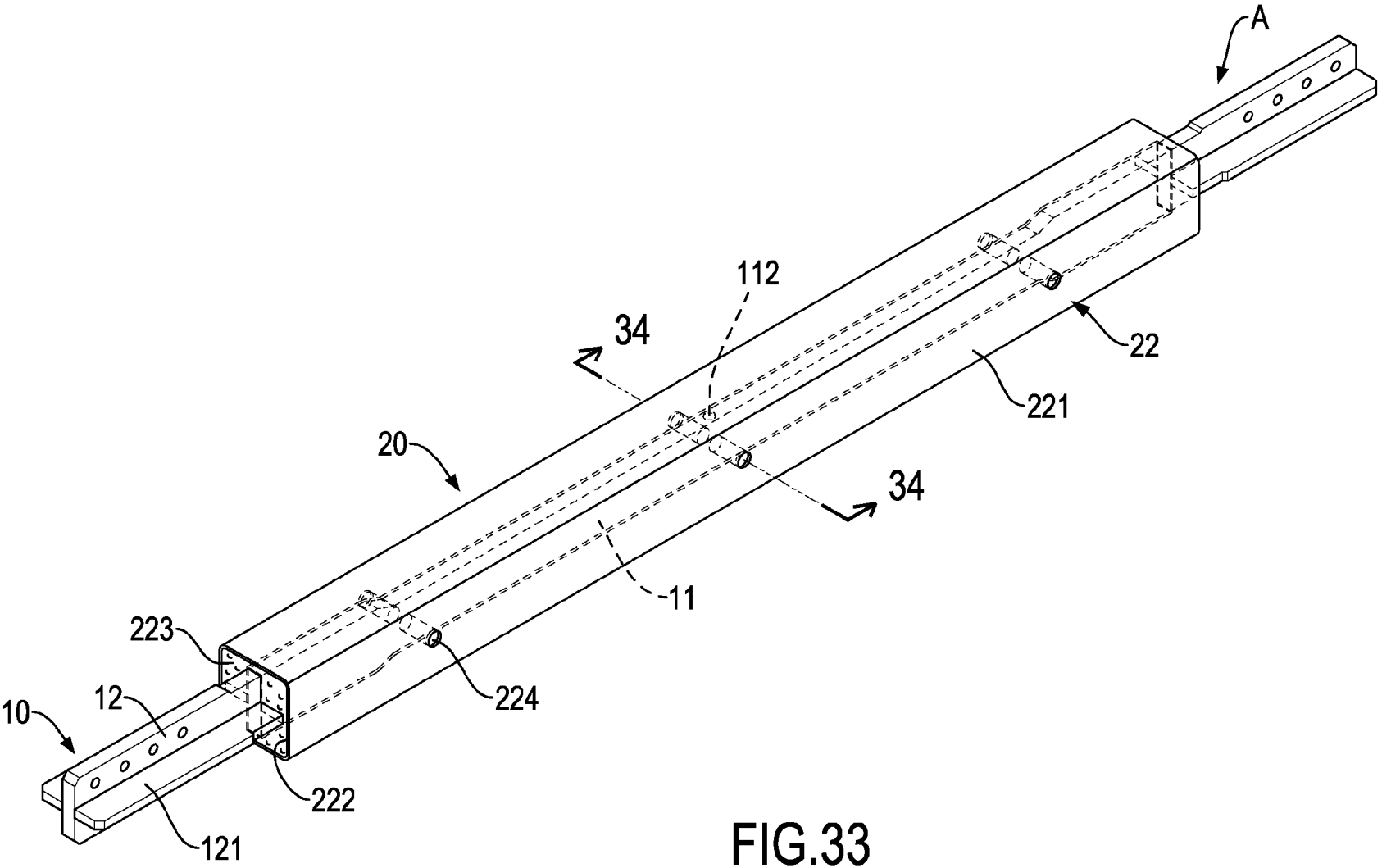
FIG. 33 is a perspective view of a twenty-ninth embodiment of a bracing device in accordance with the present invention.
Figure 34:
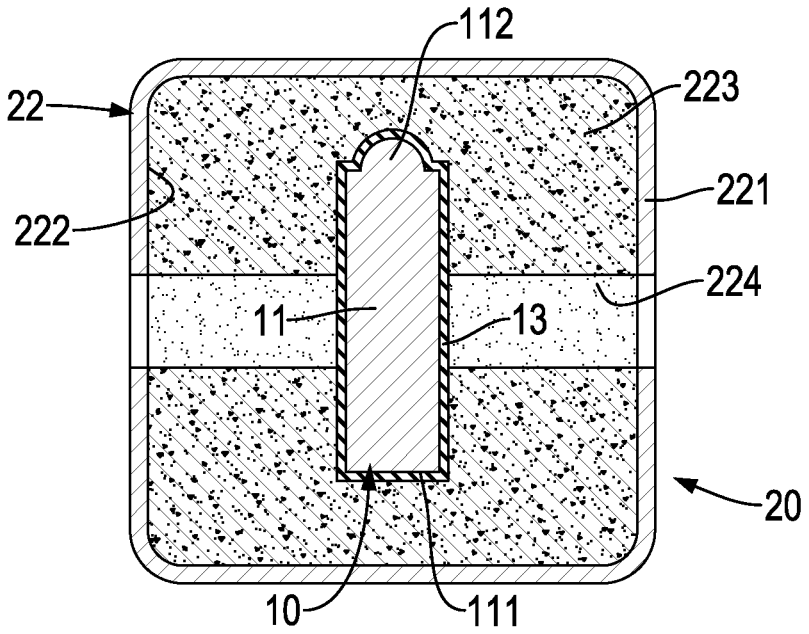
FIG. 34 is an enlarged side view of the bracing device along line 34-34 in FIG. 33.

With reference to FIGS. 33 and 34, in a twenty-ninth embodiment of a bracing device in accordance with the present invention, the bracing device has a supporting module A and a restraining module 20.

The supporting module A has an elongated-plate-shaped supporting element 10. The supporting element 10 has an axial segment 11, two connecting heads 12 and a detaching member 13. The axial segment 11 has a first side, a second side, two sidewalls and two connecting ends, two concave edges 111 and a protruding block 112. The concave edges 111 are respectively formed in the sidewalls of the axial segment 11. The protruding block 112 is formed on and protrudes from one of the sidewalls of the axial segment 11 at a middle of the axial segment 11. The connecting heads 12 are respectively formed on the connecting ends of the axial segment 11. Each connecting head 12 has a cross shape, two protruding ribs 121 and multiple connecting holes. The protruding ribs 121 are connected to each other in a cross type to form the cross-shaped connecting head 12. The connecting holes are formed through the protruding ribs 121.

The restraining module 20 is mounted around the axial segment 11 of the supporting element 10 and has a restraining board 22. The restraining board 22 has a restraining frame 221, a filling member 223 and three viewing holes 224. The restraining frame 221 is mounted around the axial segment 11 of the supporting element 10 and has a rectangular or circular cross section and a filling recess 222. The filling recess 222 is formed in the restraining frame 221. The filling member 223 is mounted in the filling recess 222 of the restraining frame 221, abuts on the detaching member 13 of the supporting element 10 and engages the protruding block 112 to prevent the restraining module 20 from moving relative to the supporting element 10. The viewing holes 224 are formed through the restraining frame 221 and the filling member 223 of the restraining board 22 at intervals corresponding to the axial segment 11 of the supporting element 10 to enable a user to see the axial segment 11 of the supporting element 10.

Figure 35:
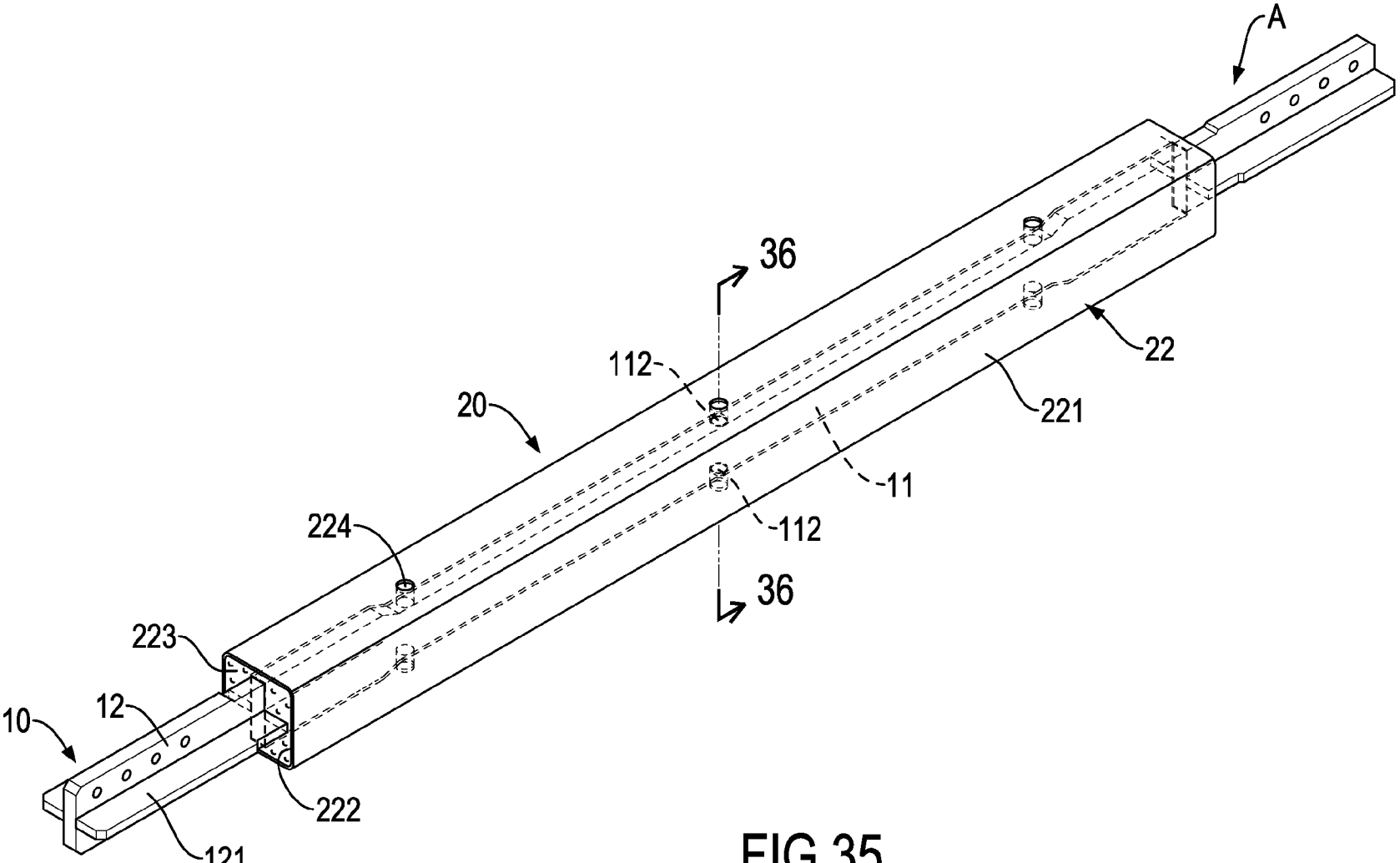
FIG. 35 is a perspective view of a thirtieth embodiment of a bracing device in accordance with the present invention.
Figure 36:
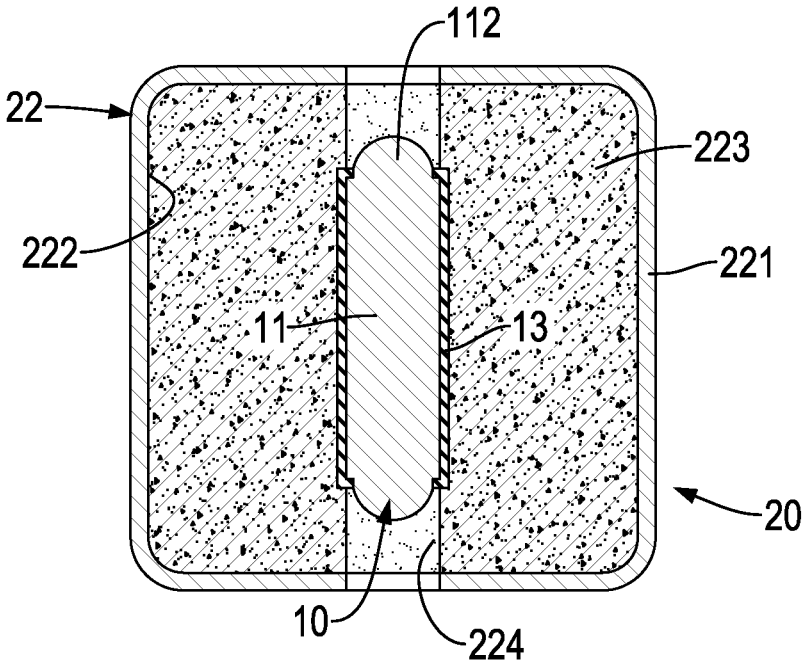
FIG. 36 is an enlarged side view of the bracing device along line 36-36 in FIG. 35.

With reference to FIGS. 35 and 36, a thirtieth embodiment of a bracing device in accordance with the present invention is substantially the same as the twenty-ninth embodiment in FIGS. 33 and 34 except the following features. The axial segment 11 has two protruding blocks 112, the protruding blocks 112 are respectively formed on and protrude from the sidewalls of the axial segment 11 at a middle of the axial segment 11. The viewing holes 224 are formed through the restraining frame 221 and the filling member 223 of the restraining board 22 at intervals along the strong axis direction of the axial segment 11.

Figure 37:
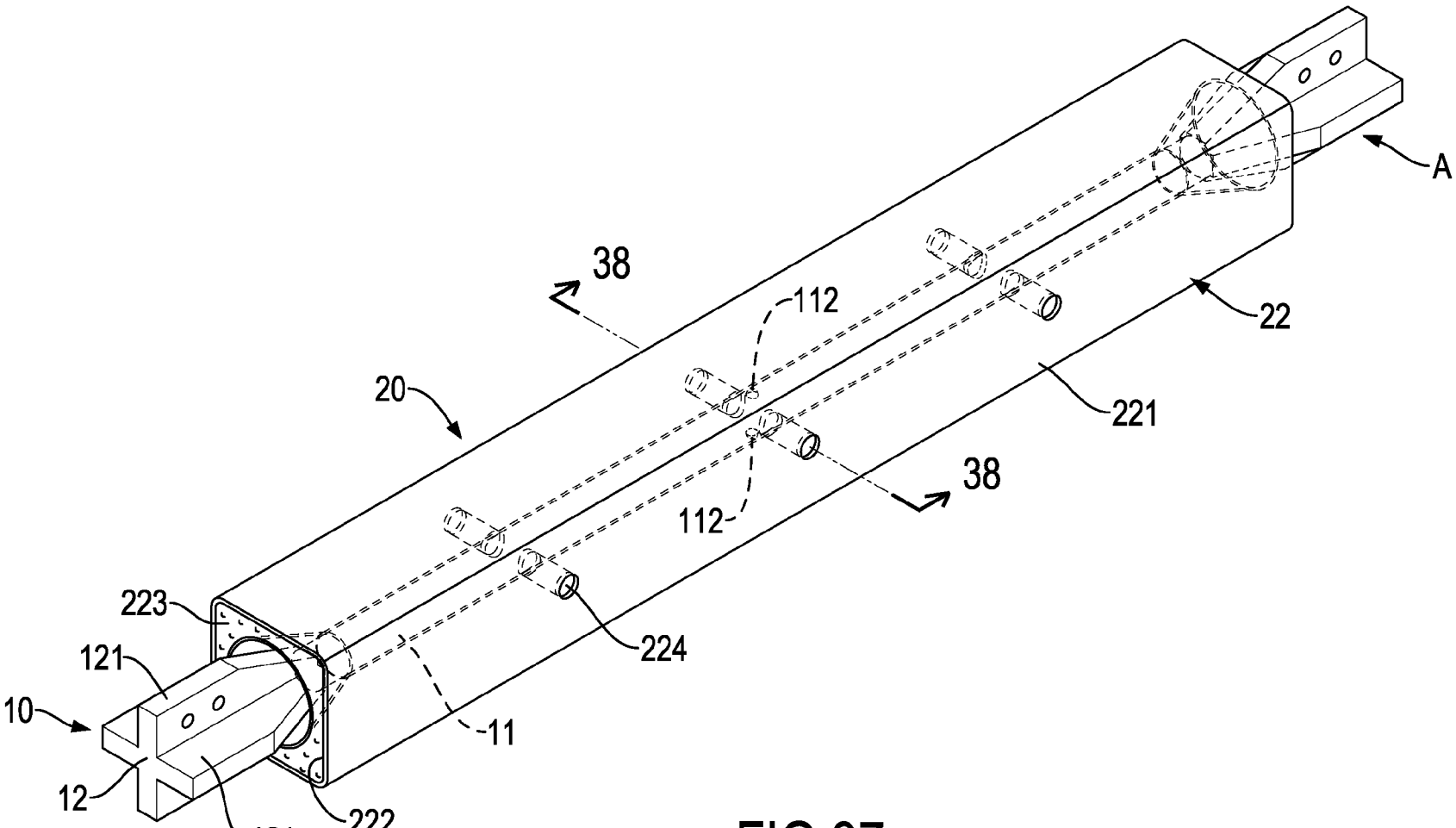
FIG. 37 is a perspective view of a thirty-first embodiment of a bracing device in accordance with the present invention.
Figure 38:
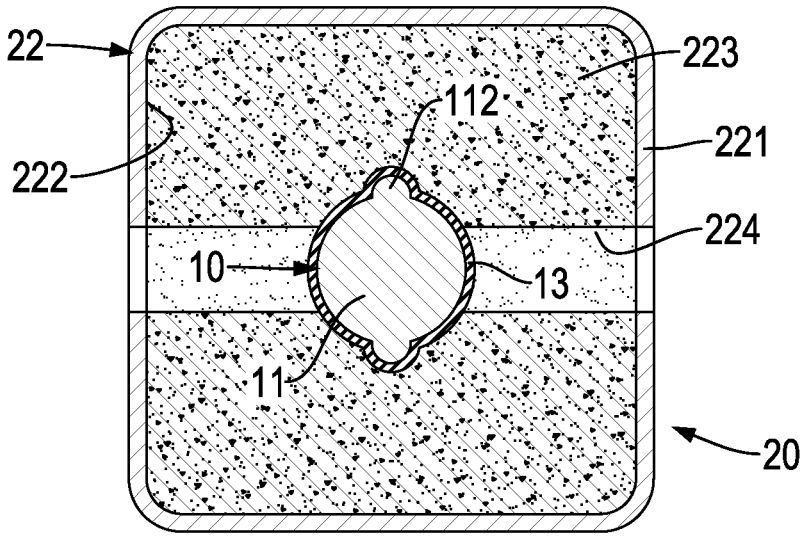
FIG. 38 is an enlarged side view of the bracing device along line 38-38 in FIG. 37.

With reference to FIGS. 37 and 38, a thirty-first embodiment of a bracing device in accordance with the present invention is substantially the same as the thirtieth embodiment in FIGS. 35 and 36 except the following features. The axial segment 11 of the supporting element has a circular cross section and the restraining board 22 has two opposite sidewalls and three viewing holes 224. The opposite sidewalls of the restraining board 22 face to each other and are mounted beside the axial segment 11 of the supporting element 10. The viewing holes 224 are formed through the opposite sidewalls of the restraining board 22 at intervals corresponding to the axial segment 11 of the supporting element 10.

Figure 39:
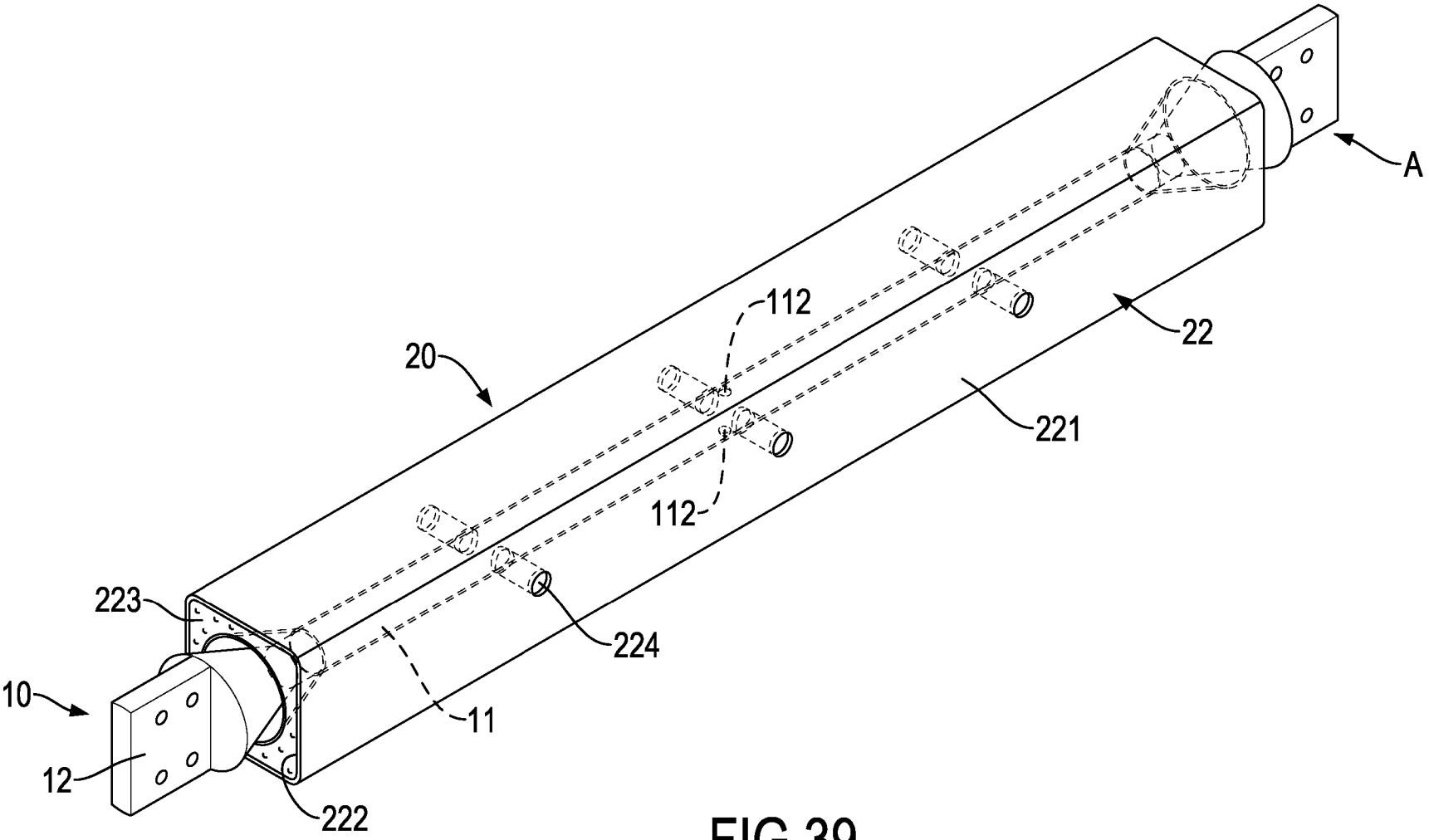
FIG. 39 is a perspective view of a thirty-second embodiment of a bracing device in accordance with the present invention.

With reference to FIG. 39, a thirty-second embodiment of a bracing device in accordance with the present invention is substantially the same as the thirty-first embodiment in FIGS. 37 and 38 except the following features. Each one of the connecting heads 12 has a conical block connected to one of the connecting ends of the axial segment 11 of the supporting element 10.

Figure 40:
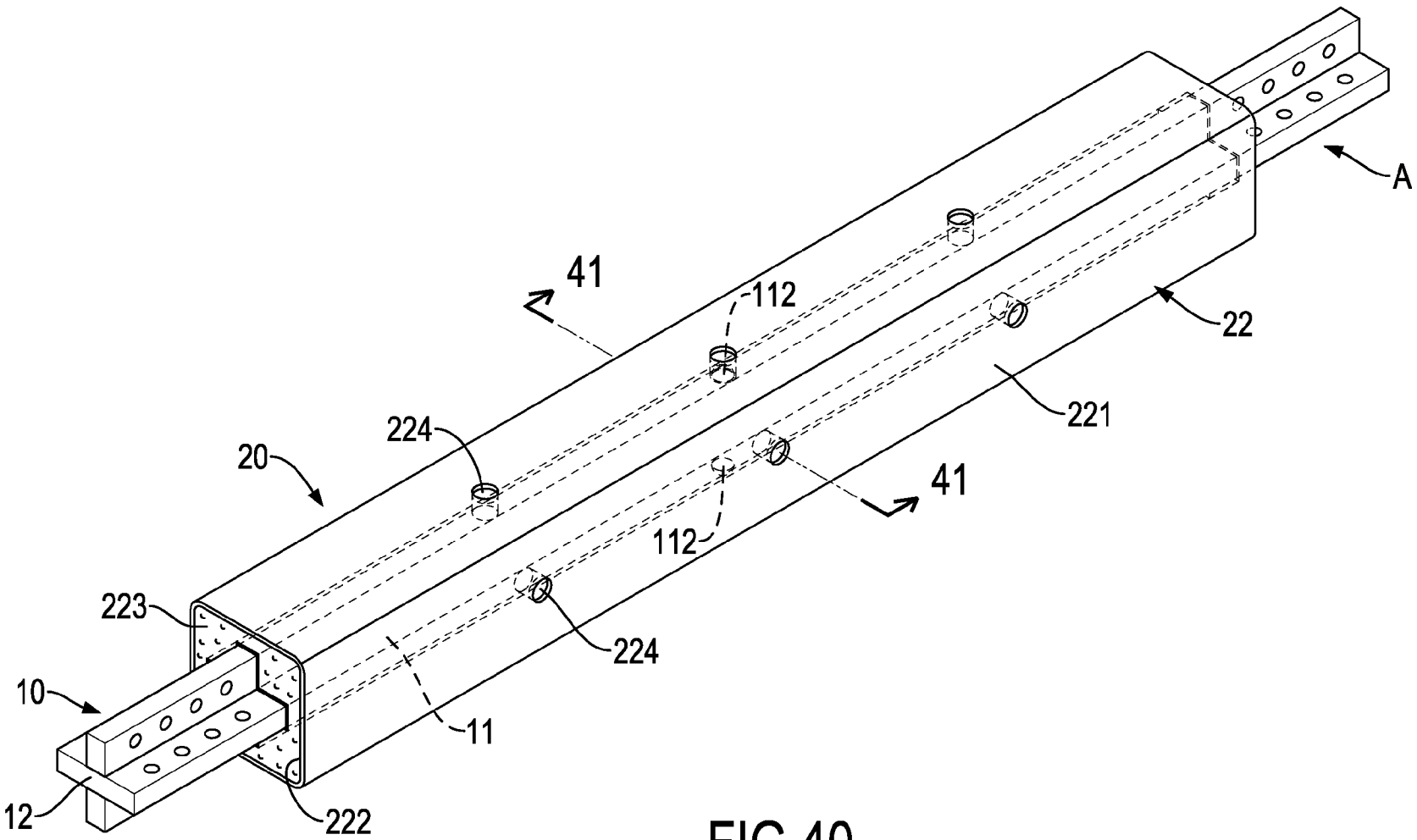
FIG. 40 is a perspective view of a thirty-third embodiment of a bracing device in accordance with the present invention.
Figure 41:
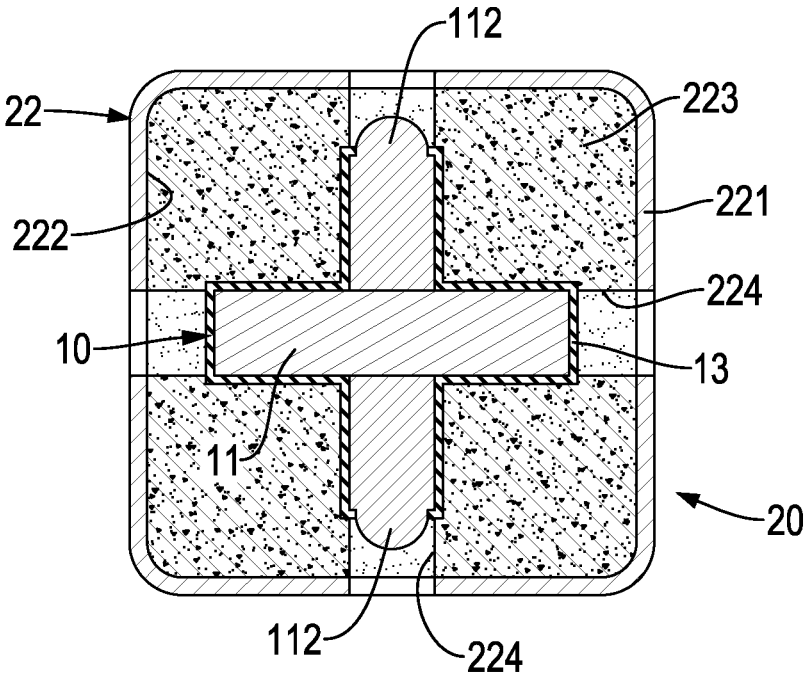
FIG. 41 is an enlarged side view of the bracing device along line 41-41 in FIG. 40.

With reference to FIGS. 40 and 41, in a thirty-third embodiment of a bracing device in accordance with the present invention, the bracing device has a supporting module A and a restraining module 20. The supporting module A has a cross shaped cross section, an axial segment 11, two connecting heads 12 and a detaching member 13. The axial segment 11 has four sidewalls and two connecting ends and at least one protruding block 112. The at least one protruding block 112 is formed on and protrudes from one of the sidewalls of the axial segment 11 at a middle of the axial segment 11. The connecting heads 12 are respectively formed on the connecting ends of the axial segment 11. The detaching member 13 is mounted on the sidewalls of the axial segment 11.

The restraining module 20 is mounted around the axial segment 11 of the supporting element 10 and has a restraining board 22. The restraining board 22 has a restraining frame 221, a filling member 223 and multiple viewing holes 224. The restraining frame 221 is mounted around the axial segment 11 of the supporting element 10 and has a rectangular cross section, four sidewalls and a filling recess 222. The filling recess 222 is formed in the restraining frame 221. The filling member 223 is mounted in the filling recess 222 of the restraining frame 221, abuts on the detaching member 13 of the supporting element 10 and engages the at least one protruding block 112 to prevent the restraining module 20 from moving relative to the supporting element 10. Three of the viewing holes 224 are formed through each one of the sidewalls of the restraining frame 221 corresponding to the axial segment 11 of the supporting element 10.

Figure 42:
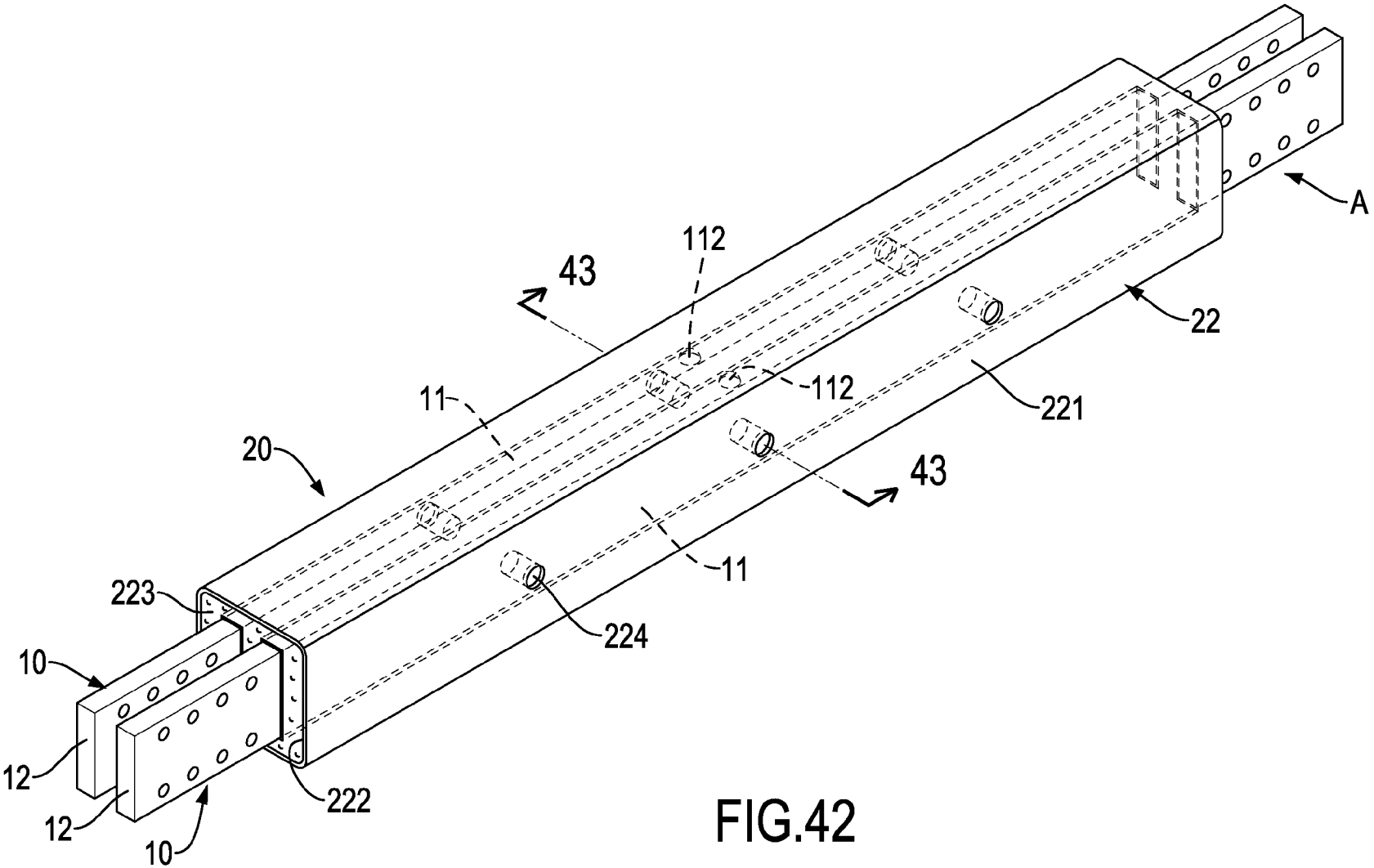
FIG. 42 is an exploded perspective view of a thirty-fourth embodiment of a bracing device in accordance with the present invention.
Figure 43:
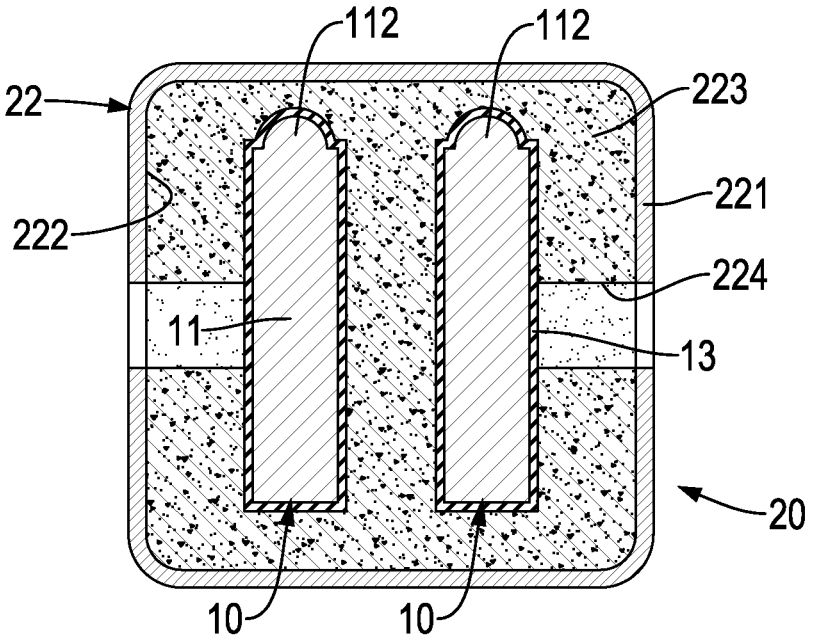
FIG. 43 is an enlarged side view of the bracing device along line 43-43 in FIG. 42.

With reference to FIGS. 42 and 43, a thirty-fourth embodiment of a bracing device in accordance with the present invention is substantially the same as the thirty-third embodiment in FIGS. 40 and 41 except the following features. The supporting module A has a pair of supporting elements 10. The supporting elements 10 parallel to each other at an interval. Each one of the connecting heads 12 of each one of the supporting elements 10 is flat and has multiple connecting holes. The restraining board 22 has two opposite sidewalls and six viewing holes 224. Three of the viewing holes 224 are formed through one of the opposite sidewalls of the restraining board 22 corresponding to the axial segment 11 of one of the supporting elements 10, and the other three viewing holes 224 are formed through the other opposite sidewall of the restraining board 22 corresponding to the axial segment 11 of the other supporting element 10.

Figure 44:
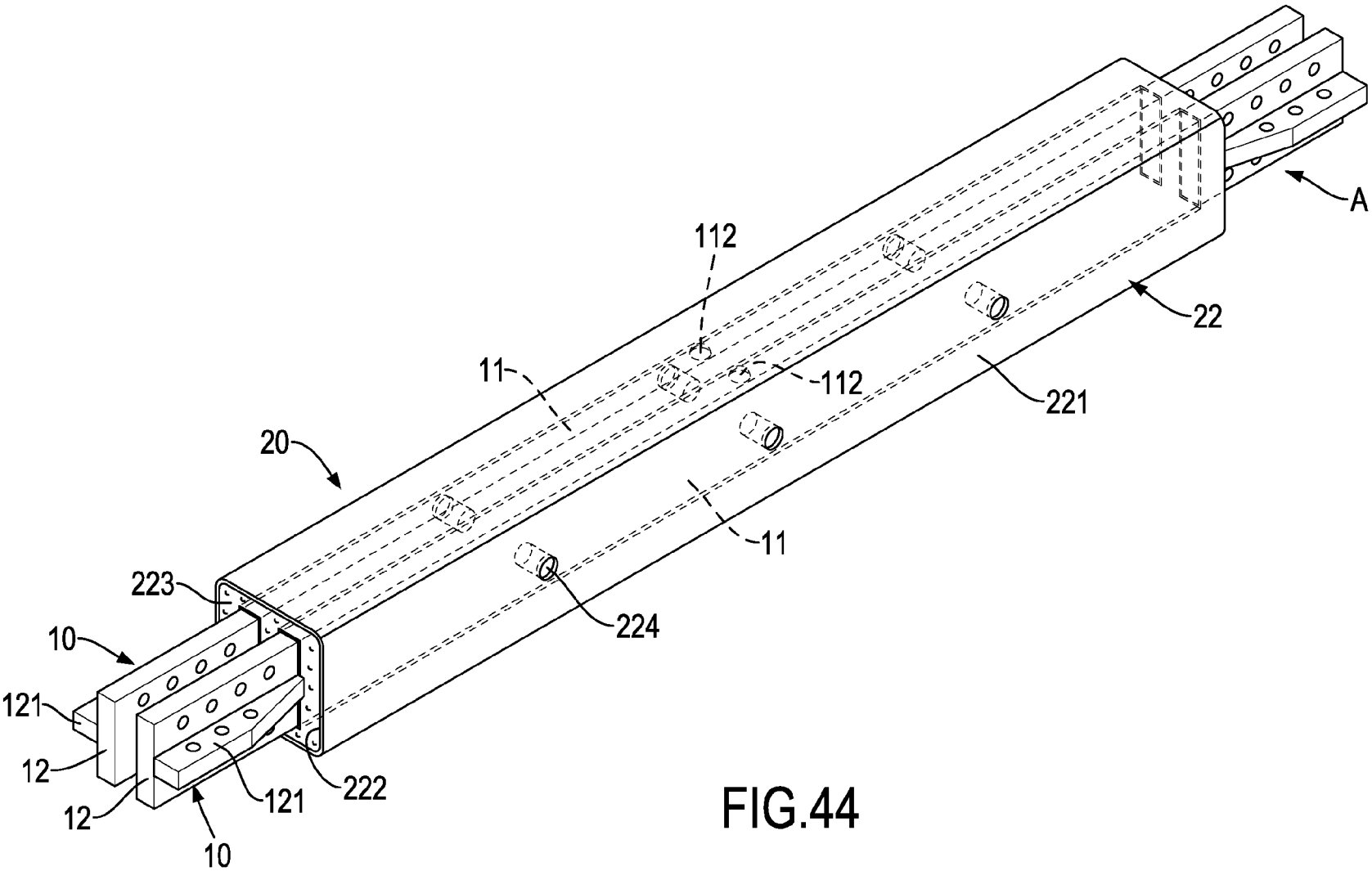
FIG. 44 is an exploded perspective view of a thirty-fifth embodiment of a bracing device in accordance with the present invention.

With reference to FIG. 44, a thirty-fifth embodiment of a bracing device in accordance with the present invention is substantially the same as the thirty-fourth embodiment in FIGS. 42 and 43 except the following features. Each one of the connecting heads 12 of each one of the supporting elements 10 has multiple connecting holes and a protruding rib 121. The connecting holes are formed through the connecting head 12. The protruding rib 121 is formed on and protrudes from the connecting head 12 between the connecting holes. Then, each one of the connecting heads 12 of each one of the supporting elements 10 has a T-shape cross section.

Figure 45:
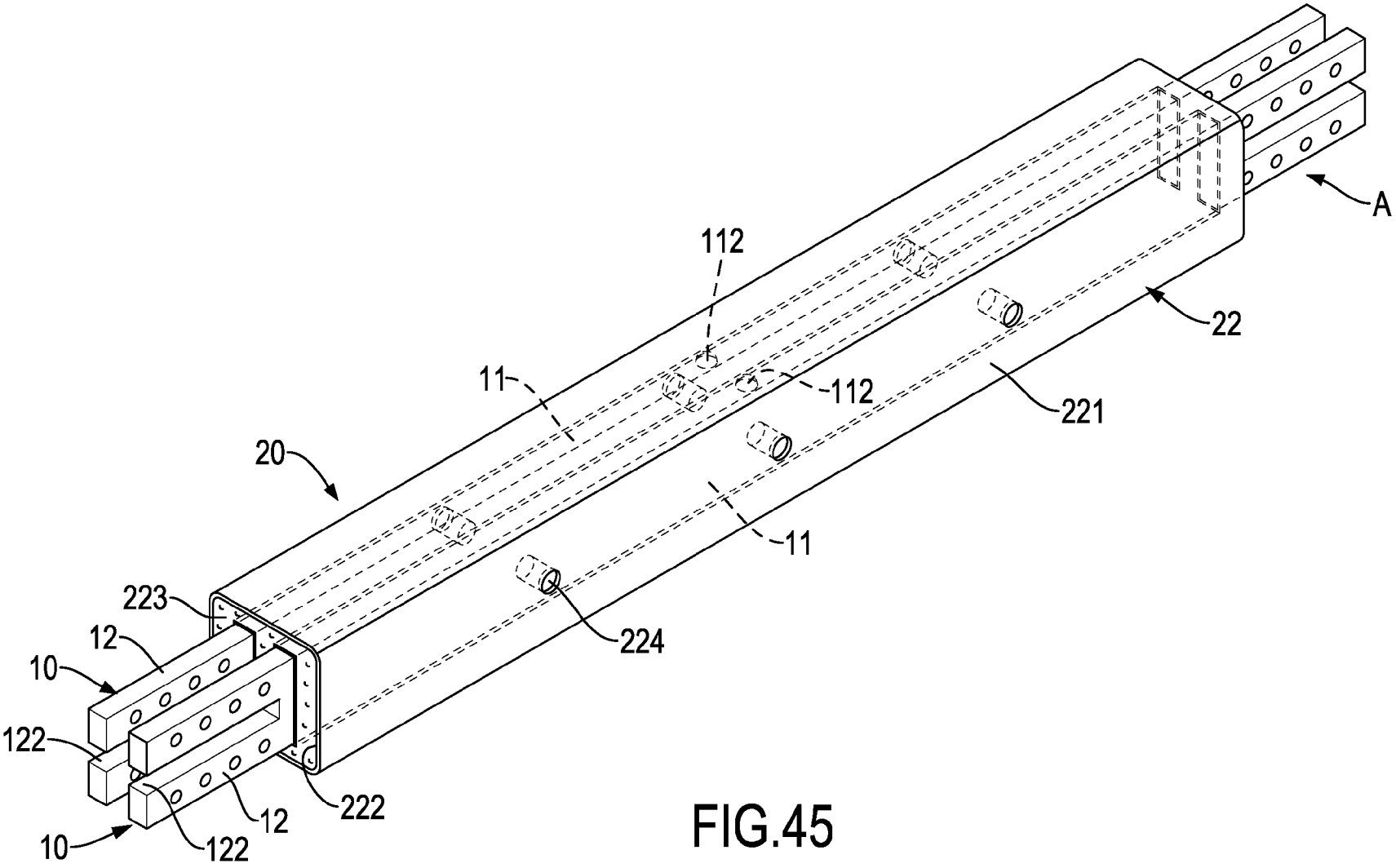
FIG. 45 is an exploded perspective view of a thirty-sixth embodiment of a bracing device in accordance with the present invention.

With reference to FIG. 45, a thirty-sixth embodiment of a bracing device in accordance with the present invention is substantially the same as the thirty-fourth embodiment in FIGS. 42 and 43 except the following features. Each one of the connecting heads 12 of each one of the supporting elements 10 has multiple connecting holes and a connecting notch 122. The connecting holes are formed through the connecting head 12. The connecting notch 122 is formed through the connecting head 12 between the connecting holes.

Figure 46:
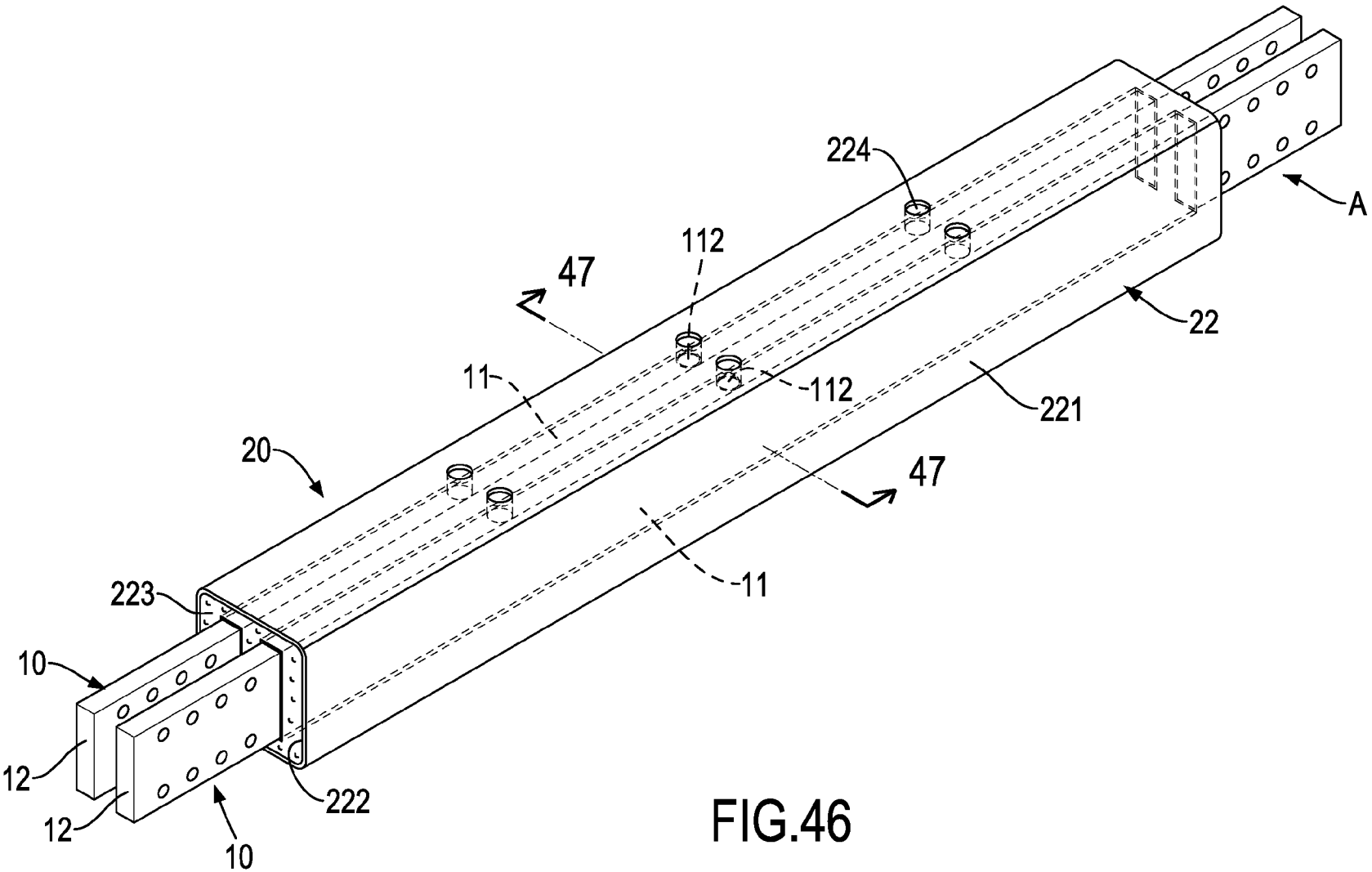
FIG. 46 is a perspective view of a thirty-seventh embodiment of a bracing device in accordance with the present invention.
Figure 47:
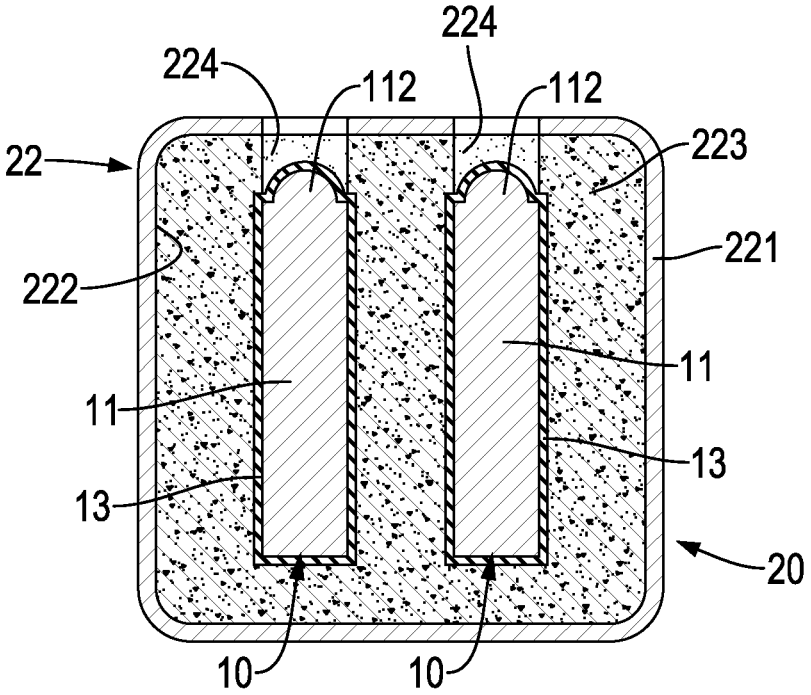
FIG. 47 is an enlarged side view of the bracing device along line 47-47 in FIG. 46.

With reference to FIGS. 46 and 47, a thirty-seventh embodiment of a bracing device in accordance with the present invention is substantially the same as the thirty-fourth embodiment in FIGS. 42 and 43 except the following features. The restraining board 22 has four sidewalls and six viewing holes 224. Three of the viewing holes 224 are formed through one of the sidewalls of the restraining board 22 at intervals along the strong axis direction of the axial segment 11 of one of the supporting elements 10, and the other three viewing holes 224 are formed through the corresponding sidewall of the restraining board 22 at intervals along the strong axis direction of the axial segment 11 of the other supporting element 10.

Figure 48:
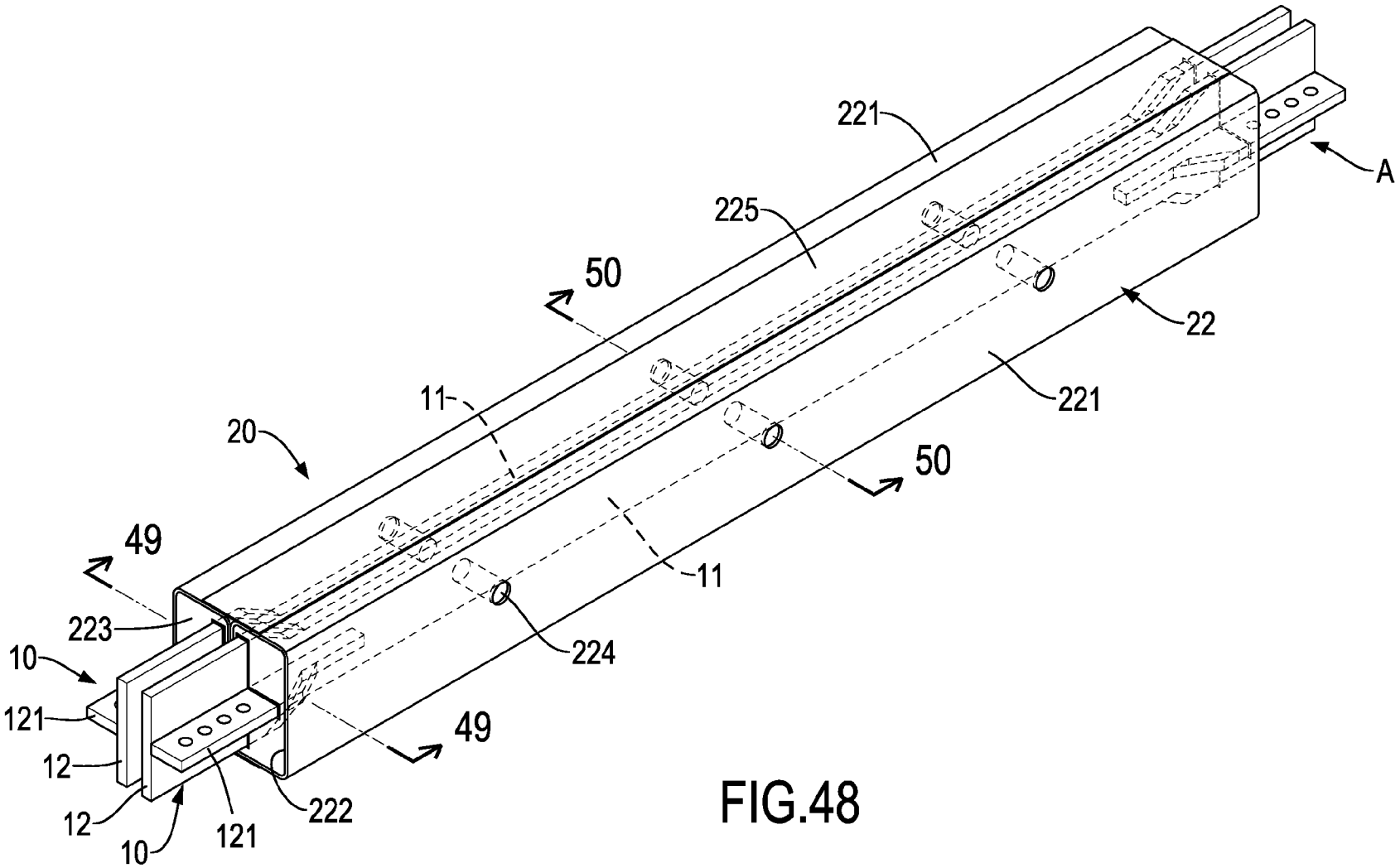
FIG. 48 is an exploded perspective view of a thirty-eighth embodiment of a bracing device in accordance with the present invention.
Figure 49:
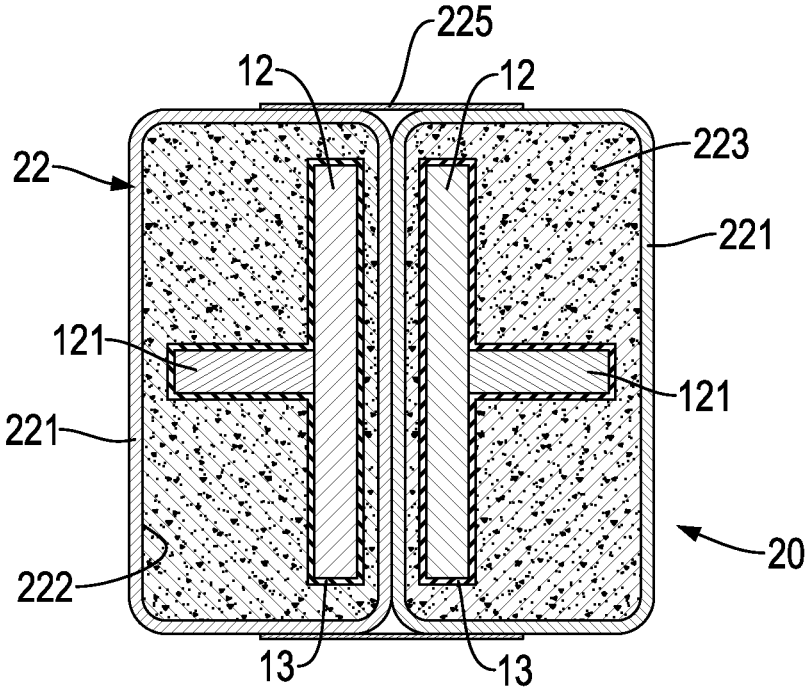
FIG. 49 is an enlarged side view of the bracing device along line 49-49 in FIG. 48.
Figure 50:
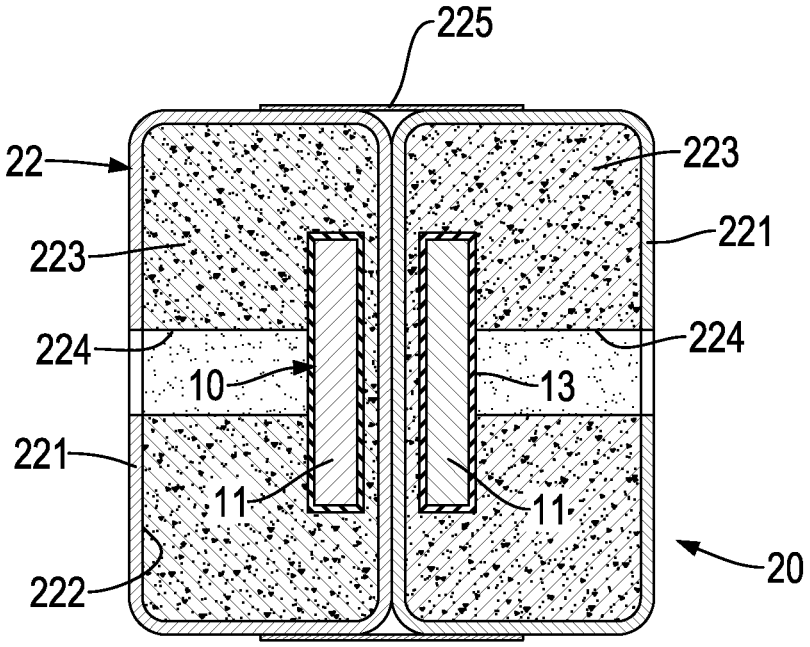
FIG. 50 is another enlarged side view of the bracing device along line 50-50 in FIG. 48.

With reference to FIGS. 48 to 50, in a thirty-eighth embodiment of a bracing device in accordance with the present invention, the bracing device has a supporting module A and a restraining module 20. The supporting module A has two supporting elements 10. The supporting elements 10 parallel with each other, and each one of the supporting elements 10 has an axial segment 11, two connecting heads 12 and a detaching member 13. The axial segment 11 is elongated-plate-shaped and has two sidewalls, two connecting ends and two concave edges 111. The concave edges 111 are respectively formed in the sidewalls of the axial segment 11. The connecting heads 12 are T-shaped and are respectively formed on the connecting ends of the axial segment 11. The detaching member 13 is mounted on the axial segment 11.

The restraining module 20 is mounted around the axial segment 11 of the supporting elements 10 and has two restraining boards 22 and two connecting plates 225. The restraining boards 22 are respectively mounted around the supporting elements 10 and abut on each other, and each one of the restraining boards 22 has a restraining frame 221, a filling member 223 and three viewing holes 224. The restraining frame 221 is mounted around the axial segment 11 of one of the supporting elements 10 and has a sidewall and a filling recess 222. The filling recess 222 is formed in the restraining frame 221. The filling member 223 is mounted in the filling recess 222 of the restraining frame 221, and abuts on the detaching member 13 of the corresponding supporting element 10. The viewing holes 224 are formed through the sidewall of the restraining frame 221 at intervals corresponding to the axial segment 11 of the corresponding supporting element 10. The connecting plates 225 are securely connected to the restraining frames 221 of the restraining boards 22 to hold the restraining boards 22 with each other.

Figure 51:
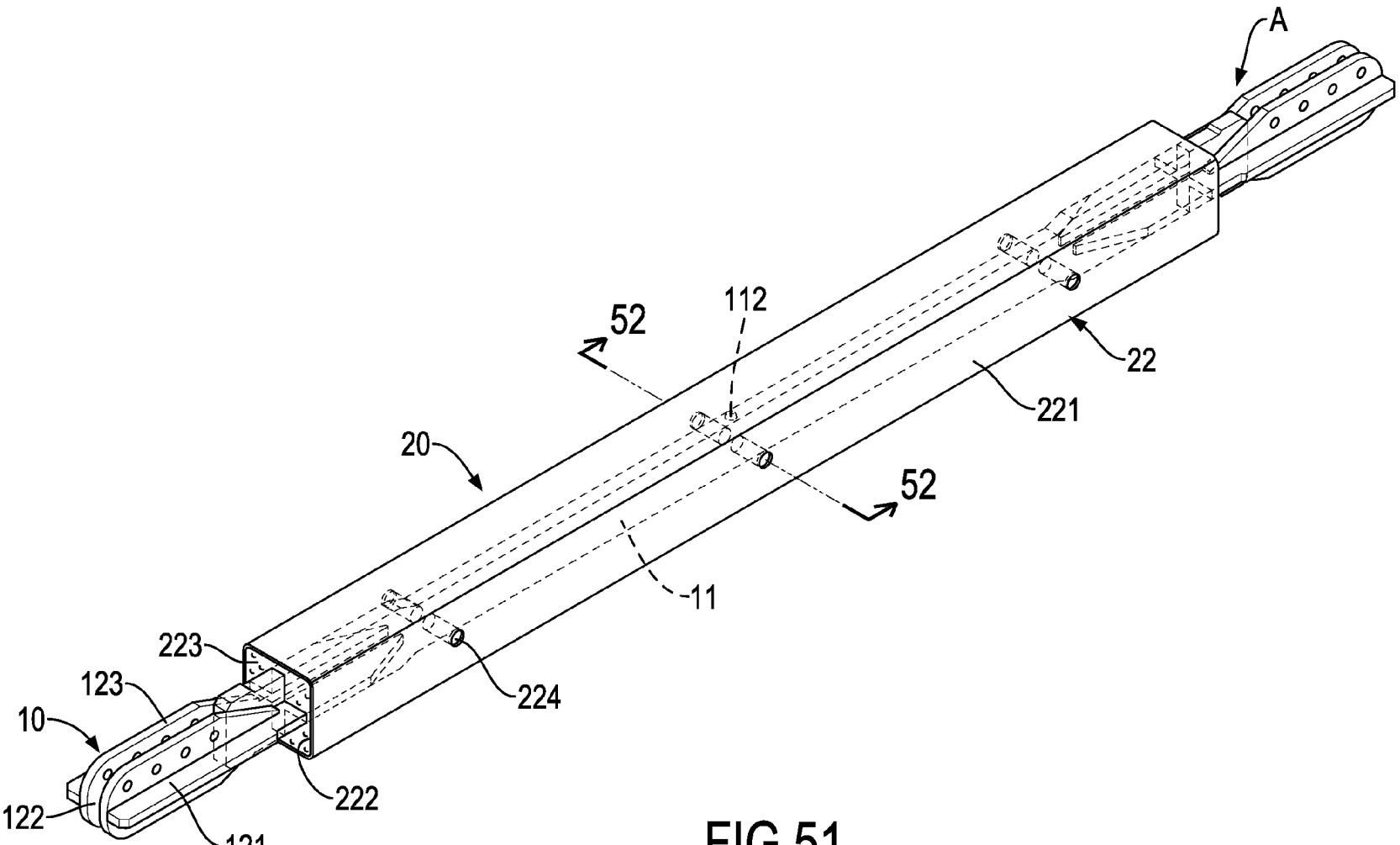
FIG. 51 is an exploded perspective view of a thirty-ninth embodiment of a bracing device in accordance with the present invention.
Figure 52:
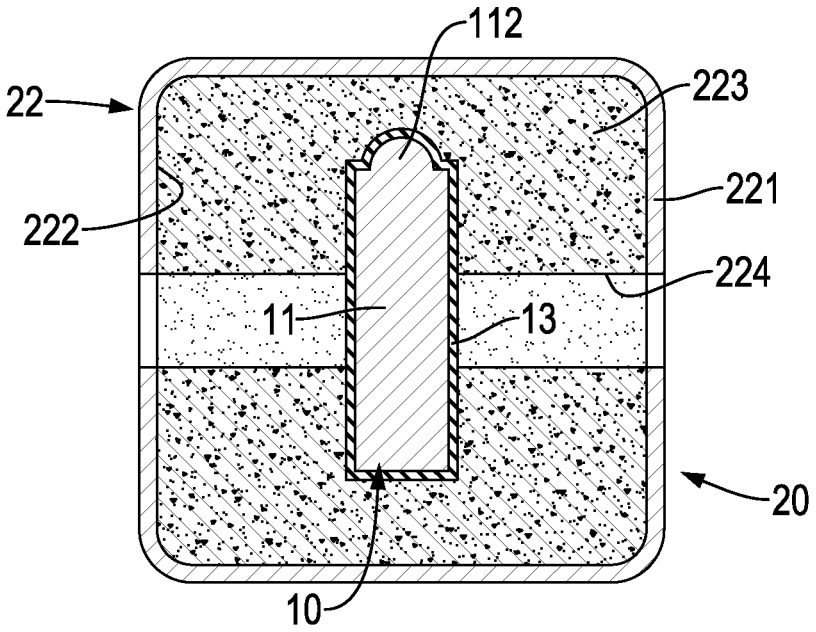
FIG. 52 is an enlarged side view of the bracing device along line 52-52 in FIG. 51.

With reference to FIGS. 51 and 52, a thirty-ninth embodiment of a bracing device in accordance with the present invention is substantially the same as the twenty-ninth embodiment in FIGS. 33 and 34 except the following features. Each one of the connecting heads 12 of the supporting element 10 has two linking tabs 123, two protruding ribs 121 and a connecting notch 122. The linking tabs 123 face to each other and are connected to one of the connecting ends of the axial segment 11 of the supporting element 10, and each one of the linking tabs 123 has an inner side and an outer side. The inner sides of the linking tabs 123 face to each other at an interval. The protruding ribs 121 are respectively and vertically formed on and protrude from the outer sides of the linking tabs 123. The connecting notch 122 is formed in the connecting head 12 between the inner sides of the linking tabs 123.

Figure 53:
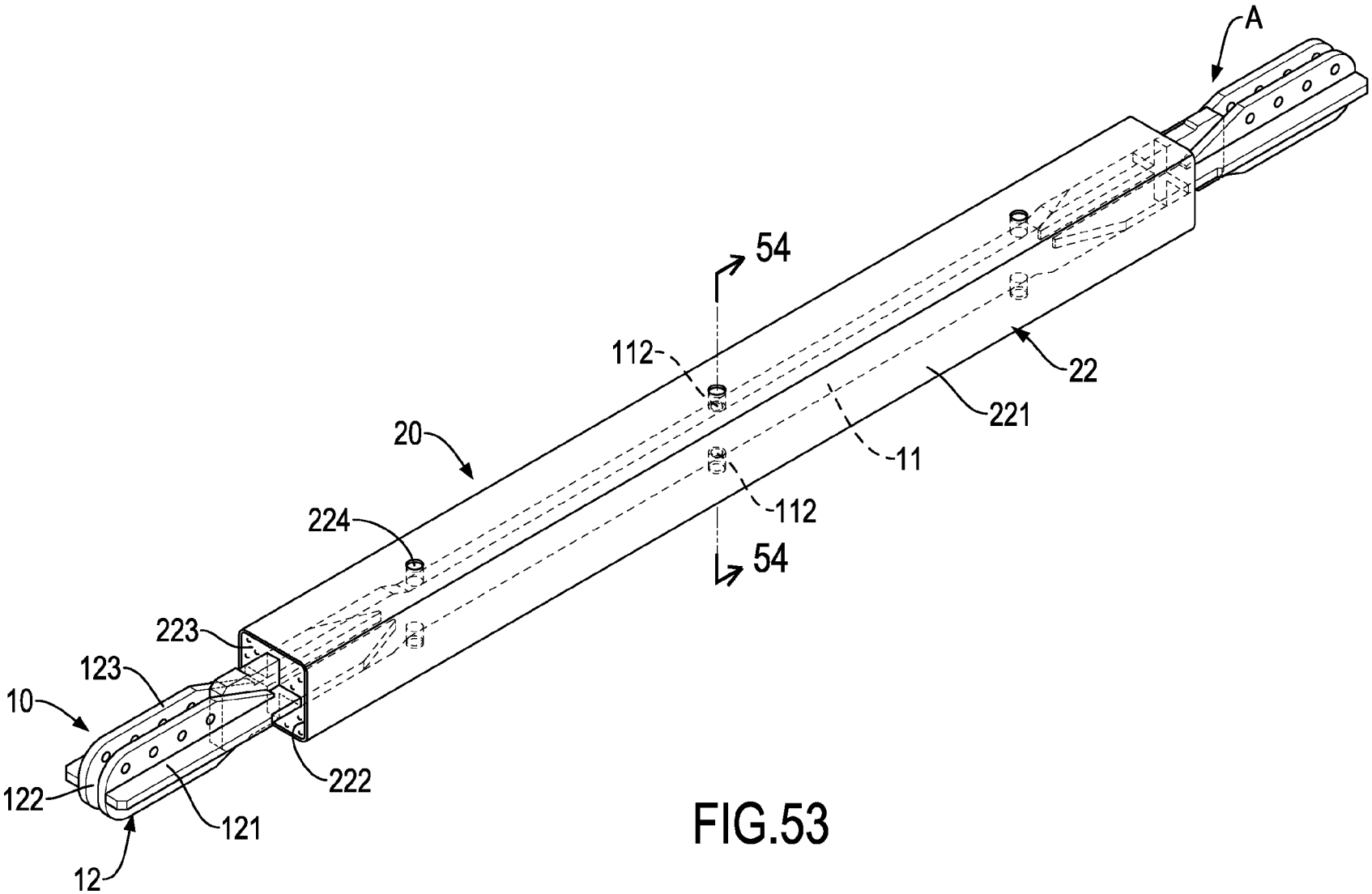
FIG. 53 is an exploded perspective view of a fortieth embodiment of a bracing device in accordance with the present invention.
Figure 54:
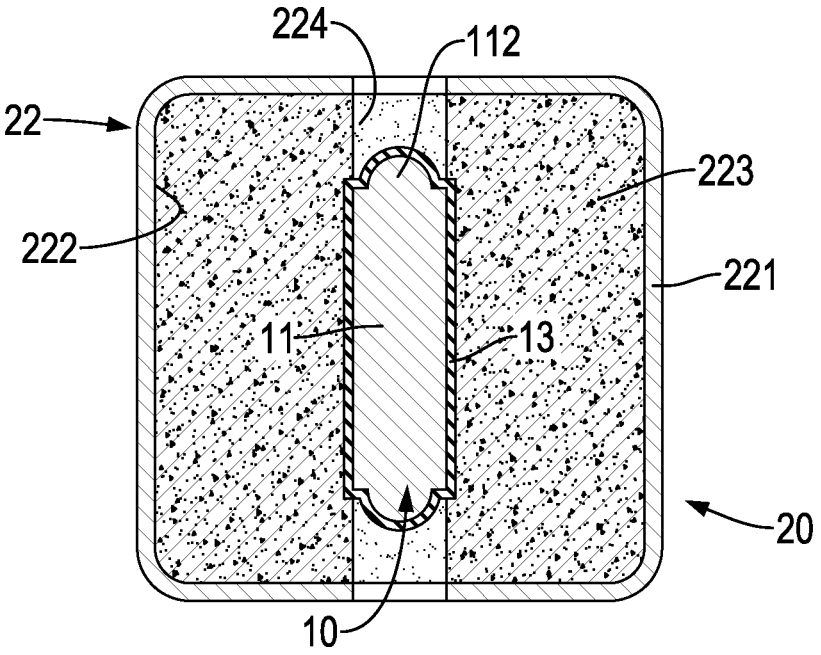
FIG. 54 is an enlarged side view of the bracing device along line 54-54 in FIG. 53.

With reference to FIGS. 53 and 54, a fortieth embodiment of a bracing device in accordance with the present invention is substantially the same as the thirty-ninth embodiment in FIGS. 51 and 52 except the following features. The restraining board 22 has three viewing holes 224 formed through the restraining board 22 at intervals along the strong axis direction of the axial segment 11 of the supporting element 10.

According to the above-mentioned embodiments of the bracing device in accordance with the present invention, after the earthquake or the strong wind, the user or an inspector can easily and conveniently see and inspect the damage and conditions of the axial segment 11 of each one of the at least one supporting element 10 of the supporting module A via the viewing holes 211, 224 of the side boards 21 and the restraining boards 22 without dismantling the restraining module 20 from the supporting module A. Then, the cost and process of re-constructing the restraining module are naturally disappeared. In addition, the inspector can inspect the structural strength of the supporting module A of the bracing device to ensure the structural safety of the building.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bracing device comprising:

a supporting module having a supporting element and having an axial segment being flat or having a cross-shaped cross section, and having at least two sidewalls;

two connecting ends; and at least one concave edge formed in each one of the at least two sidewalls of the axial segment; and two connecting heads respectively formed on the connecting ends of the axial segment; and a restraining module mounted around the supporting module and having a restraining board mounted around the axial segment of the supporting element, and having a restraining frame being tubular and mounted around the axial segment of the supporting element of the supporting module; and a filling member mounted in the restraining frame between the restraining frame and the supporting module; and at least one viewing hole formed through the restraining module and aligning with the supporting element to enable a user to see the supporting element of the bracing device.

2. The bracing device as claimed in claim 1, wherein the restraining module has at least one pair of side boards, and each one of the at least one pair of side boards mounted in one of the at least one concave edge of one of the at least two sidewalls of the axial segment; and two restraining boards mounted on the supporting element and connected to the at least one pair of side boards.

3. The bracing device as claimed in claim 2, wherein each restraining board has at least one viewing hole formed through the restraining board to align with the axial segment of the supporting element.

4. The bracing device as claimed in claim 3, wherein at least one of the at least one pair of side boards has at least one viewing hole formed through the side board to align with the axial segment of the supporting element.

5. The bracing device as claimed in claim 2, wherein at least one of the restraining boards has at least one viewing hole formed through the restraining board to align with the axial segment of the supporting element.

6. The bracing device as claimed in claim 5, wherein at least one of the at least one pair of side boards has at least one viewing hole formed through the side board to align with the axial segment of the supporting element.

7. The bracing device as claimed in claim 2, wherein at least one of the at least one pair of side boards has at least one viewing hole formed through the side board to align with the axial segment of the supporting element.

8. The bracing device as claimed in claim 1, wherein the restraining board has at least one viewing hole formed through the restraining board to align with the axial segment of the supporting element.

9. The bracing device as claimed in claim 8, wherein the axial segment of the supporting element has at least one protruding block formed on and protruding from the axial segment.

10. The bracing device as claimed in claim 9, wherein the axial segment of the supporting element has a detaching member mounted on the axial segment of the supporting element.

11. The bracing device as claimed in claim 1, wherein the axial segment of the supporting element has a detaching member mounted on the axial segment.

12. The bracing device as claimed in claim 1, wherein the axial segment of the supporting element has at least one protruding block formed on and protruding from the axial segment.

13. The bracing device as claimed in claim 1, wherein each one of the connecting heads is flat or has a protruding rib to enable the connecting head to be a T shape or has two protruding ribs to enable the connecting head to be a cross shape or has a connecting notch formed through the connecting head or has two linking tabs connected to one of the connecting ends of the axial segment and two protruding ribs respectively formed on and protruding from the linking tabs.

14. The bracing device as claimed in claim 1, wherein the restraining board has a rectangular or circular cross section.

15. The bracing device as claimed in claim 14, wherein the axial segment of the supporting element has a detaching member mounted on the axial segment of the supporting element.

* * * * *